US007755283B2

(12) United States Patent
Ryu et al.

(10) Patent No.: US 7,755,283 B2
(45) Date of Patent: Jul. 13, 2010

(54) PLASMA DISPLAY APPARATUS

(75) Inventors: Seong Nam Ryu, Busan-si (KR); Woo Gon Jeon, Gumi-si (KR); Sang Min Hong, Seoul (KR); Woo Tae Kim, Yongin-si (KR); Kyung A Kang, Busan-si (KR); Jeong Hyun Hahm, Seoul (KR); Jae Sung Kim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 538 days.

(21) Appl. No.: 11/704,276

(22) Filed: Feb. 9, 2007

(65) Prior Publication Data

US 2007/0279329 A1 Dec. 6, 2007

(30) Foreign Application Priority Data

May 30, 2006 (KR) ..... 10-2006-0048818

(51) Int. Cl.
*H01J 17/49* (2006.01)

(52) U.S. Cl. ..... 313/582

(58) Field of Classification Search ..... 313/582–587, 313/490–494

See application file for complete search history.

(56) References Cited

U.S. PATENT DOCUMENTS 6,522,072 B1 2/2003 Yura et al. ..... 313/582
6,628,077 B2 * 9/2003 Shirozu ..... 313/587
2001/0050533 A1 * 12/2001 Hirose ..... 313/583
2002/0003515 A1 * 1/2002 Lee et al. ..... 345/60
2003/0146713 A1 8/2003 Nagao et al. ..... 315/169.4
2004/0032215 A1 2/2004 Nishimura et al. ..... 315/169.3
2004/0041522 A1 3/2004 Takada et al. ..... 313/586
2005/0029941 A1 * 2/2005 Kwon et al. ..... 313/582

FOREIGN PATENT DOCUMENTS

CN 1319244 10/2001
CN 1581404 2/2005
EP 1 030 340 A2 8/2000

OTHER PUBLICATIONS

European Search Report dated Dec. 12, 2008.

* cited by examiner

*Primary Examiner*—Toan Ton
*Assistant Examiner*—Hana A Sanei
(74) *Attorney, Agent, or Firm*—Ked & Associates LLP

(57) ABSTRACT

The present invention relates to a plasma display apparatus, which includes a front substrate; a plurality of first, second electrodes formed on the front substrate; a rear substrate that is faced with the front substrate; a plurality of third electrodes formed on the rear substrate; and a discharge cell that is disposed in the place where the first, the second electrode intersect with the third electrode, wherein at least one of the first and the second electrode is formed with one layer, wherein the width or the length of the first and the second electrode arranged in the adjacent discharge cells are different each other. Accordingly, the manufacturing cost can be decreased by eliminating the transparent electrode made of ITO, the color temperature and the luminance of the plasma display panel ca be increased by asymmetrically forming R, G, B discharge cell.

16 Claims, 24 Drawing Sheets

PLASMA DISPLAY APPARATUS

This application claims the benefit of Korean Patent Application No. 10-2006-0048818 filed on May 30, 2006, which is hereby incorporated by reference for all purposes as if fully set forth herein.

BACKGROUND OF THE INVENTION

1. Field of the Invention

The present invention relates, in general, to a plasma display apparatus and, more particularly, to a panel equipped in a plasma display apparatus.

2. Description of the Related Art

A plasma display panel is an apparatus for displaying an image including a characteristic and a graphic by performing a discharge through applying a predetermined voltage to electrodes arranged in a discharge space, and by exciting the phosphor with the plasma generated in the gaseous discharge time. The plasma display panel has an advantage in that a large size, a light weight and a plane thin shaping are facilitated, the wide viewing angle to the up rear left right can be provided, and the full-color and the high luminance can be implemented.

FIG. 1 is a drawing showing the structure of a plasma display panel of the related art. Referring to FIG. 1, as to a plasma display apparatus, a front panel 100 and a rear panel 110 is disposed in parallel with a constant distance. On the front panel 100, a plurality of sustain electrode pairs are disposed on a front substrate 101 where an image is displayed, when the sustain electrode pair is comprised of a scan electrode 102 and a sustain electrode 103. On the rear panel 100 which is a backside, a plurality of address electrodes intersecting with the plurality of sustain electrode pairs are disposed on a rear substrate 111.

The front panel 100 is comprises of a scan electrode 102 including a transparent electrode 102*a*, 103*a* and a bus electrode 102*b*, 103*b*, and a sustain electrode 103 while the scan electrode 102 and the sustain electrode 103 form a pair and a transparent electrode 102*a*, 103*a* is made of a transparent Indium Tin Oxide ITO. The scan electrode 102 and the sustain electrode 103 are covered with a front dielectric layer 104. The protective layer 105 is formed on the front dielectric layer 104 so as to protect the front dielectric layer 104 from the sputtering of the charged particles generated in the gaseous discharge time and enhance the emission efficiency of the secondary electron.

The rear panel 110 includes a barrier rib 112 for partitioning off a discharge cell. A plurality of address electrodes 113 are arranged in parallel with the barrier rib 112. On the address electrode 113, Red R, Green G, and Blue B phosphors 114 are coated. A rear dielectric layer 115 is formed between the address electrode 113 and the phosphors 114.

In the meantime, the transparent electrodes 102*a*, 103*a* comprising the scan electrode 102 or the sustain electrode 103 is made of ITO which is expensive. Transparent electrode 102*a*, 103*a* causes the raising of the manufacturing cost of the plasma display panel. Therefore, manufacturing the plasma display panel which can obtain the sufficient color matching function and the driving characteristic for a user while decreasing the manufacturing cost is requested in recent days.

SUMMARY

Accordingly, the present invention has been made in view of the above problems occurring in the prior art, and it is an object of the present invention to provide a plasma display apparatus capable of improving the flickering of the display image, the spot generation, the luminance and the color temperature, reducing the manufacturing cost by eliminating the transparent electrode made of ITO.

To achieve the above object, according to an aspect of the present invention, there is provided a plasma display apparatus, including a front substrate; a plurality of first, second electrodes formed on the front substrate; a rear substrate that is faced with the front substrate; a plurality of third electrodes formed on the rear substrate; and a discharge cell that is disposed in the place where the first, the second electrode intersect with the third electrode, wherein at least one of the first and the second electrode is formed with one layer, wherein the width of the first and the second electrode arranged in a first discharge cell among a plurality of discharge cells are different from the width of the first and the second electrode arranged in a second discharge cell that radiates a color which is different from the color of the first discharge cell.

According to an aspect of the present invention, at least one of the plurality of the first, the second electrode arranged in the first discharge cell and the second discharge cell comprises a line portion formed in the direction intersecting with the third electrode; and a protrusion protruded from the line portion.

The plasma display apparatus according to an aspect of the present invention further comprises a front dielectric layer covering the first, the second electrode, wherein at least one of the first and the second electrode is darker than the front dielectric layer.

The width of the first, the second electrode arranged in the first discharge cell is larger than the width of the first, the second electrode arranged in the second discharge cell.

The width of the first, the second electrode arranged in the second discharge cell ranges from 0.70 times to 0.98 times of the width of the first, the second electrode arranged in the first discharge cell.

The first discharge cell is a cell radiating a red light or a green light; and the second discharge cell is a cell radiating a blue light.

The width of the protrusion arranged in the second discharge cell ranges from 0.70 times to 0.98 times of the width of the protrusion arranged in the first discharge cell.

The protrusion forms at least one closed loop.

According to an aspect of the present invention, on the rear substrate, a dielectric layer; a barrier rib partitioning off the discharge cell; and a phosphor layer is formed.

The protrusion is two or more.

The plasma display apparatus according to another aspect of the present invention comprises a front substrate; a plurality of first, second electrodes formed on the front substrate; a rear substrate that is faced with the front substrate; a plurality of third electrodes formed on the rear substrate; a discharge cell that is disposed in the place where the first, the second electrode intersect with the third electrode, a line portion formed in the direction intersecting with the third electrode; and a protrusion protruded from the line portion.

According to another aspect of the present invention, at least one of the plurality of the first and the second electrodes is formed with one layer, wherein the length of the protrusion arranged in a first discharge cell among a plurality of discharge cells is different from the length of the protrusion arranged in a second discharge cell that radiates a color which is different from the color of the first discharge cell.

The length of the protrusion arranged in the first discharge cell is longer than the length of the protrusion arranged in the second discharge cell.

The length of the protrusion arranged in the second discharge cell ranges from 0.70 times to 0.98 times of the length of the protrusion arranged in the first discharge cell.

The protrusion is two or more.

The first discharge cell is a cell radiating a red light or a green light; and the second discharge cell is a cell radiating a blue light.

The plasma display apparatus according to further aspect of the present invention comprises a front substrate; a plurality of first, second electrodes formed on the front substrate; a rear substrate that is faced with the front substrate; a plurality of third electrodes formed on the rear substrate; a discharge cell that is disposed in the place where the first, the second electrode intersect with the third electrode, a line portion formed in the direction intersecting with the third electrode; and a protrusion protruded from the line portion, wherein at least one of the plurality of the first and the second electrodes is formed with one layer, wherein the width of the first and the second electrode arranged respectively in a first discharge cell, a second discharge cell, and a third discharge cell that radiate a different light among a plurality of discharge cells is different from each other.

The width of the first, the second electrode arranged in the first discharge cell ranges from 0.80 times to 0.98 times of the width of the first, the second electrode arranged in the second discharge cell.

The width of the first, the second electrode arranged in the third discharge cell ranges from 0.80 times to 0.98 times of the width of the first, the second electrode arranged in the first discharge cell.

The first discharge cell is a cell radiating a green light, the second discharge cell is a cell radiating a red light; and the third discharge cell is a cell radiating a blue light.

The plasma display apparatus according to further aspect of the present invention further comprises a front dielectric layer covering the first, the second electrode, wherein at least one of the first and the second electrode is darker than the front dielectric layer.

BRIEF DESCRIPTION OF THE DRAWINGS

The present invention will be described in detail with reference to the following drawings in which like numerals refer to like elements. The accompany drawings, which are included to provide a further understanding of the present invention and are incorporated in and constitute a part of this specification, illustrate embodiments of the present invention and together with the description serve to explain the principles of the present invention. In the drawings.

DETAILED DESCRIPTION OF THE EMBODIMENTS

Preferred embodiments of the present invention will be described in a more detailed manner with reference to the drawings.

Figure 2:
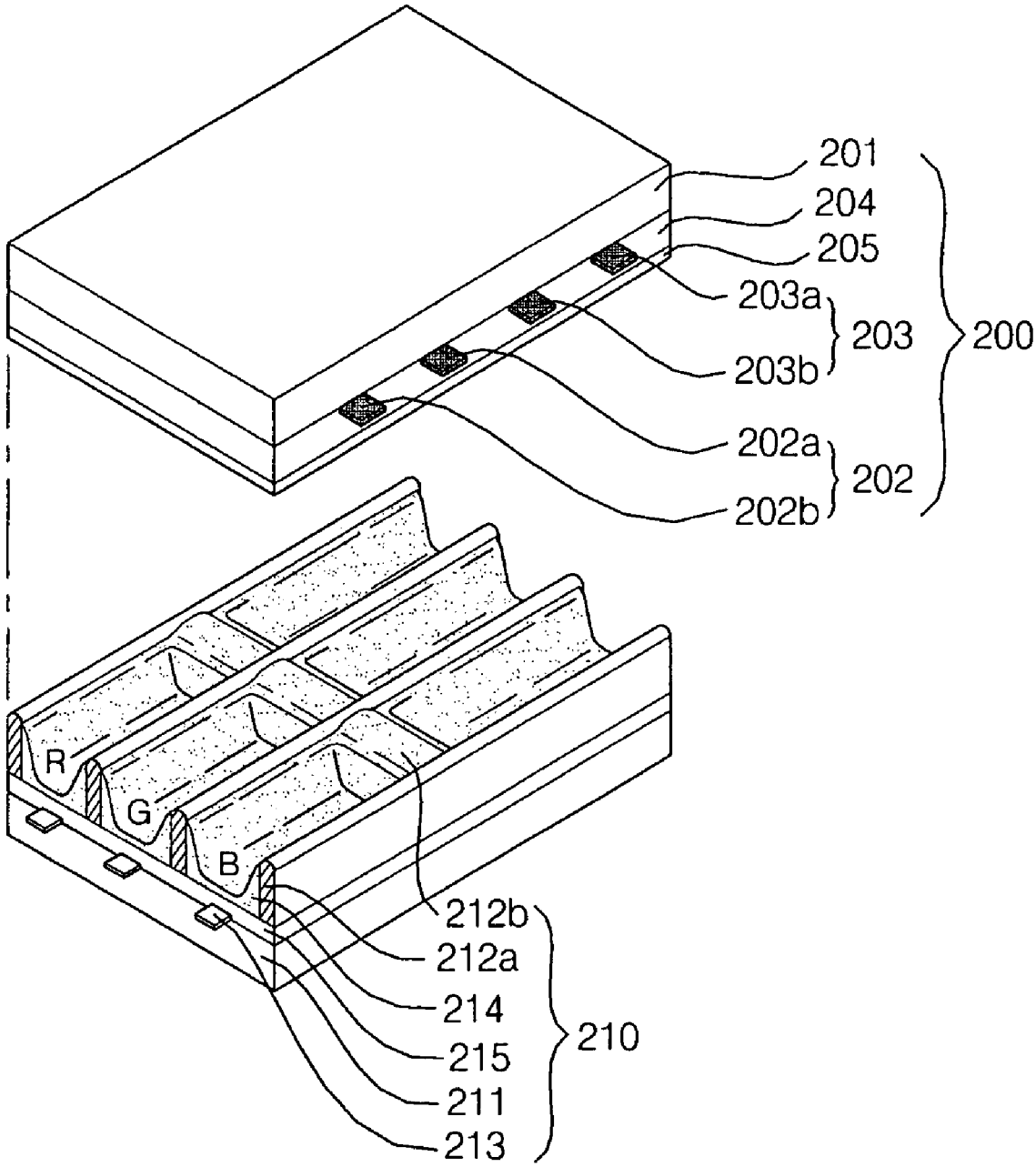
FIG. 2 is a drawing showing an embodiment of the structure of a panel equipped in a plasma display apparatus according to the present invention.

Hereinafter, FIG. 2 is a drawing showing an embodiment of the structure of a panel equipped in a plasma display apparatus according to the present invention.

Referring to FIG. 2, the plasma display panel includes a front panel 200 and a rear panel 210 coalesced with a predetermined gap.

The front panel 200 includes a sustain electrode pair 202, 203 which is formed on a front substrate 201 with forming a pair. According to a function, the sustain electrode pair 202, 203 are classified into a scan electrode 202 and a sustain electrode 203. The sustain electrode pair 202, 203 is covered with a front dielectric layer 204 that limits the discharge current and insulates between the electrode pair. A passivation layer 205 is formed on the top of the front dielectric layer 204, thereby, the front dielectric layer 204 is protected from the sputtering of the charged particles generated during the gaseous discharge and the emission efficiency of the secondary electron can be enhanced.

On the rear panel 210, a barrier rib 212 partitioning off a plurality of discharge spaces, that is, a discharge cell is formed on the lower substrate 211. Further, an address electrode 213 is arranged in the direction intersecting with sustain electrode pair 202, 203. A phosphor 214 which is light-emitted by the ultraviolet ray generated during the gaseous discharge time to generate a visible light is coated onto the surface of the barrier rib 212 and the rear dielectric layer 215.

At this time, the barrier rib 212 is comprised of a column barrier rib 212*a* developed into the direction in parallel with the address electrode 213, and a row barrier rib 212*b* developed into the direction intersecting with the address electrode 213, which divides the discharge cell physically and prevents the ultraviolet ray generated by a discharge and the visible light from being leaked out into the adjacent discharge cell.

In this way, the inactive gas containing a main gas including Ne, He, or the mixed gas Ne+He, and a small amount of xenon are filled in the discharge cell surrounded by the barrier rib 212*a*, 212*b*. At this time, it is preferable that the pressure of the gas in the panel ranges from 350 Torr to 500 Torr. A proper amount of gas, in that case, for enhancing the discharge efficiency is filled, and the difficulty of manufacturing due to the gas pressure in the panel manufacturing processing is removed and can be readily manufactured.

Figure 1:
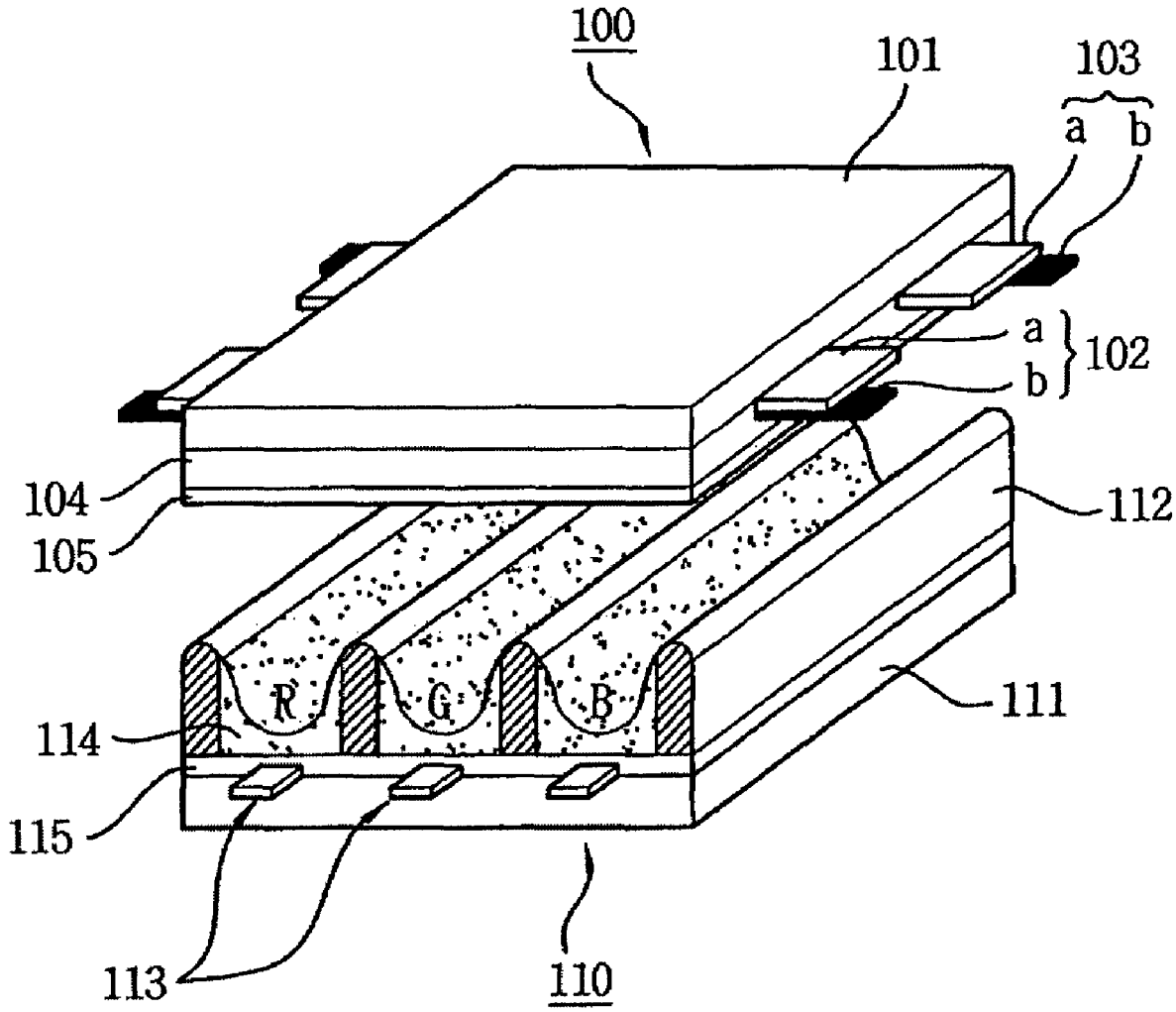
Fig.1 (related art)
FIG. 1 is a drawing showing the structure of a plasma display panel of the related art.

Further, in the plasma display panel according to an embodiment of the present invention, the sustain electrode pair 202, 203 is made of an opaque metal electrode differently from the sustain electrode pair 102, 103 shown in FIG. 1. That is, ITO which is a conventional transparent electrode material is not used, while the sustain electrode pair 202, 203 is formed by using the conventional material of the bus electrode such as Ag, Cu or Cr. That is, each sustain electrode pair 202, 203 of the plasma display panel according to the embodiment of the present invention does not include the conventional ITO electrode. The sustain electrode pair 202, 203 of the plasma display panel according to the embodiment of the present invention is made of one layer with the sole bus electrode.

For example, it is preferable that the sustain electrode pair 202, 203 according to the embodiment of the present invention is made of silver. It is preferable that the silver Ag has the photosensitivity property. Further, it is preferable that the sustain electrode pair 202, 203 according to the embodiment of the present invention is more gloomy and the permeability of the light is more low than the front dielectric layer 204 formed on the front substrate 201.

It is preferable that the thickness of the electrode lines 202*a* 202*b*, 203*a*, 203*b* range from 3 μm to 7 μm. In case the electrode lines 202*a* 202*b*, 203*a*, 203*b* are formed with a range of such thickness, with obtaining a range of resistance with which the plasma display panel can normally operate and a necessary aperture ratio, the light reflected to the front of the plasma display apparatus can be prevented from the reduction of luminance of an image resulting from the blocking of the electrode, and the capacitance of the panel is not so much increased.

Further, the phosphor coated onto the discharge cell can radiate at least one of Red, Green, and Blue, while the phosphor is coated onto the discharge cell in sequence of R, G, B in this document.

Further, in the plasma display panel according to an embodiment of the present invention, the sustain electrode pair 202, 203 is made of an opaque metal electrode differently from the sustain electrode pair 102, 103 shown in FIG. 2. That is, ITO which is a conventional transparent electrode material is not used, while the sustain electrode pair 202, 203 is formed by using the conventional material of the bus electrode such as Ag, Cu or Cr. That is, each sustain electrode pair 202, 203 of the plasma display panel according to the embodiment of the present invention does not include the conventional ITO electrode. The sustain electrode pair 202, 203 of the plasma display panel according to the embodiment of the present invention is made of one layer with the sole bus electrode.

For example, it is preferable that the sustain electrode pair 202, 203 according to the embodiment of the present invention is made of silver. It is preferable that the silver Ag has the photosensitivity property. Further, it is preferable that the sustain electrode pair 202, 203 according to the embodiment of the present invention is more gloomy and the permeability of the light is more low than the front dielectric layer 204 formed on the front substrate 201. [내용중복 확인요망].

The structure of the panel shown in FIG. 2 is just an embodiment of the structure of a plasma display panel according to the present invention. Therefore, the present invention is not restricted to the structure of the plasma display panel shown in FIG. 2. For example, a Black Matrix BM that blocks a light to reduce a reflection by absorbing the external light generated in the outside and to improve the purity and the contrast of the front substrate 201 can be formed on the front substrate 201, while the black matrix is available with both an unitary type and a separation type.

In the meantime, the black matrix can be formed with the black layer simultaneously in the forming process to be physically connected, while they are not physically connected when they are formed in different time point. Further, in case of being physically connected to be formed, the black matrix and the black layer are formed with the same material. However, in case the black matrix and the black layer are separated physically to be formed, they can be made of other material.

Further, the plasma display panel according to the present invention shows a close type in which the discharge cell has a closed architecture due to the column barrier rib 212*a* and a row barrier rib 212*b*. However, it is not restricted to such type, but a stripe type that has only the row barrier rib 212*b* or a fish bone structure where a protrusion is formed with a predetermined gap on the column barrier rib 212*a* can be used.

In addition, as to the plasma display panel according to an embodiment of the present invention, various barrier rib structures having various shapes as well as the barrier rib structure shown in FIG. 2 is available.

A differential type barrier rib structure where the height of the column barrier rib 212*a* and the row barrier rib 212*b* are different, a channel type barrier rib structure where a channel which can be used as ventilating passage is formed in at least one of the column barrier rib 212*a* and the row barrier rib 212*b*, and a hollow type barrier rib structure where a hollow is formed in at least one of the column barrier rib 212*a* and the row barrier rib 212*b* can be used.

Here, in the differential barrier rib structure, it is preferable that the height of the row barrier rib 212*b* is higher than the height of the column barrier rib 212*a*. In the channel type barrier rib structure or the hollow type barrier rib structure, it is preferable that a channel or a hollow is formed in the row barrier rib 212*b*.

In the meantime, in the embodiment of the present invention, it is illustrated that the discharge cell R, G and B is arranged in the same line. However, the other shape can be arranged. For example, the arrangement of a delta type where the discharge cell R, G and B is arranged in a triangle form can be used. In addition, the various polygonal shape including a pentagon, a hexagon as well as the square shape can be used for the shape of the discharge cell.

Further, as to the address electrode formed on the rear substrate 211, the width or the thickness can be substantially fixed. However, the width or the thickness of the discharge cell of the inside can be different from the width or the thickness of the discharge cell of the outside. For example, the width or the thickness of the discharge cell of the inside can be broader or thicker than the width or the thickness of the discharge cell of the outside.

Figure 3:
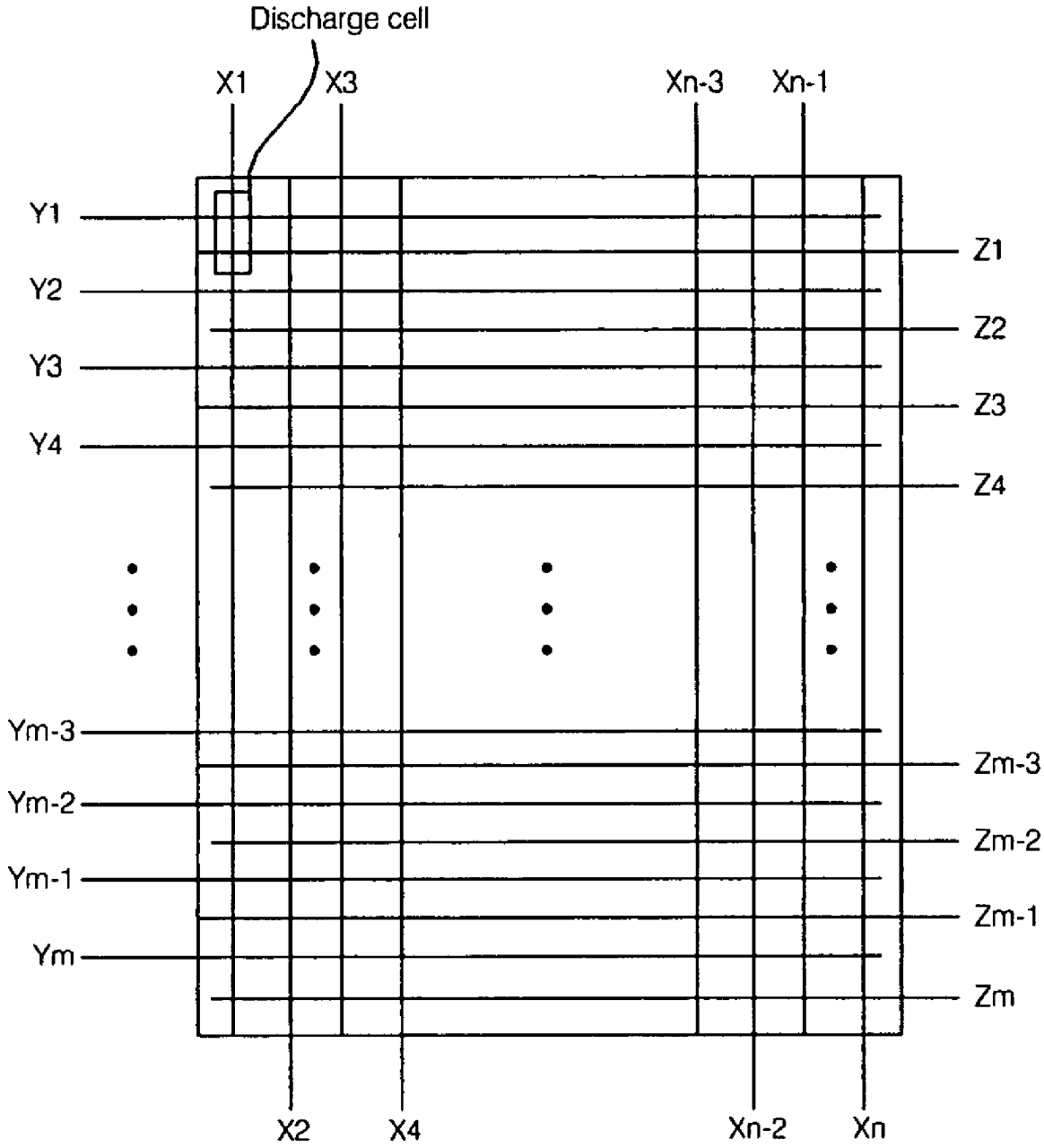
FIG. 3 is a drawing showing the embodiment of the electrode arrangement of a plasma display panel.

FIG. 3 is a drawing showing the embodiment of the electrode arrangement of a plasma display panel.

Referring to FIG. 3, it is preferable that a plurality of discharge cells forming a plasma display panel are positioned in the intersection of the scan electrode lines Y1 to Ym, the sustain electrode lines Z1 to Zm and the address electrode lines X1 to Xn, arranged as a matrix type. The scan electrode Y1 to Ym is sequentially drived, while the sustain electrode Z1 to Zm is commonly drived. The address electrode lines X1 to Xn is divided into even number lines and odd number lines to be drived.

The electrode arrangement shown in FIG. 3 is just an embodiment of the electrode arrangement of the plasma display panel according to the present invention. Therefore, the present invention is not restricted to the electrode arrangement of the plasma display panel and the driving method shown in FIG. 3.

For example, the dual scan mode or the double scan mode in which two scan electrode lines in the scan electrode lines Y1 to Ym are drived simultaneously can be available. Here, the dual scan method is a mode in which the plasma display panel is divided into two regions with an upper region and a lower region, while one scan electrode line which belongs to the upper region and the lower region respectively is drived simultaneously. On the other hand, the double scan mode is a mode in which two scan electrode lines which are sequentially arranged are drived simultaneously.

The first embodiment of the plasma display panel structure according to the present invention shown in FIG. 2 will be described in detail with FIG. 4.

Figure 4:
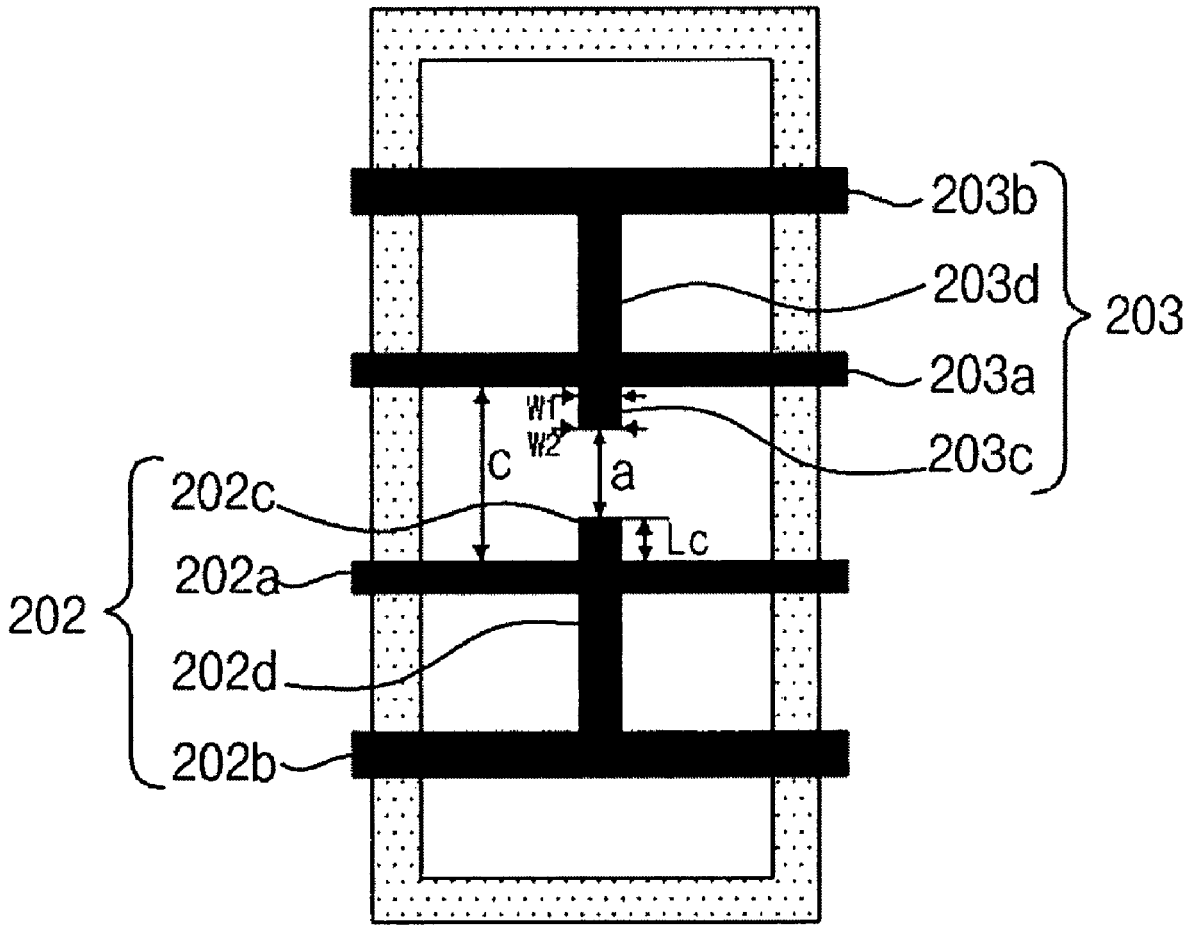
FIG. 4 is a cross-sectional view of a first embodiment of the electrode structure of a plasma display panel according to the present invention.

FIG. 4 is a cross-sectional view showing a first embodiment of the electrode structure of a plasma display panel according to the present invention, in which only the arrangement structure of the sustain electrode pair 202, 203 formed in a discharge cell in the plasma display panel shown in FIG. 2 is briefly shown.

As shown in FIG. 4, the sustain electrodes 202, 203 according to a first embodiment of the present invention are formed as a pair to be symmetrical on the substrate based on the center of the discharge cell. Each sustain electrode is comprised of a line portion including at least two electrode lines 202*a*, 202*b*, 203*a*, 203*b* crossing the discharge cell, and a protrusion including at least one projecting electrode 202*c*, 203*c* which is protruded to the center of the discharge cell in the discharge cell and connected to the electrode line 202*a*, 203*a* which is the closest to the center of the discharge cell. Further, it is preferable that, as shown in FIG. 4, each sustain electrode 202, 203 further includes one bridge electrode 202*d*, 203*d* connecting the two electrode lines 202*a* and 202*b*, 203*a* and 203*b*.

The electrode lines 202*a*, 202*b*, 203*a*, 203*b* cross the discharge cell, and extending to the direction of the plasma display panel. The electrode line according to the first embodiment of the present invention narrowly forms a width so as to improve the aperture ratio. Further, it is preferable that a plurality of electrode lines 202*a*, 202*b*, 203*a*, 203*b* are used so as to improve the discharge diffusion efficiency while the number of electrode lines are determined in consideration of the aperture ratio.

It is preferable that projecting electrodes 202*c*, 203*c* are connected to electrode lines 202*a*, 203*a* which are closest to the center of the discharge cell in one discharge cell, and protruding to the center of the discharge cell. Projecting electrodes 202*c*, 203*c* lower the firing voltage in driving the plasma display panel.

The first embodiment of the present invention includes projecting electrodes 202*c*, 203*c* connected to each electrode line 202*a*, 203*a* since the firing voltage increases due to the distance c of the electrode line 202*a*, 203*a*. The firing voltage of the plasma display panel can be lowered, since a discharge can be generated in a low firing voltage between the projecting electrodes 202*c*, 203*c* which are formed closely. Here, the firing voltage is a voltage level where a discharge is initiated when a pulse is supplied to at least one electrode.

As to the projecting electrodes 202*c*, 203*c*, the size is very small. Therefore, due to the tolerance of the manufacturing process, the width W1 of the portion connected to electrode lines 202*a*, 203*a* of projecting electrodes 202*c*, 203*c* can be broader than the width W2 of the end portion of the projecting electrode, while, if necessary, the width W2 can be broader than the width W1.

It is preferable that the gap between two adjacent electrode lines that form a sustain electrode pair 203, 202 respectively, that is, the gap between 203*a* and 203*b* or the gap between 202*a* and 202*b*, ranges from 80 μm to 120 μm. In case the gap between two adjacent electrode lines has such value, the aperture ratio of the plasma display panel can be obtained sufficiently, the luminance of the display image can be increased, and the discharge diffusion efficiency in a discharge space can be increased.

It is preferable that the width W1 of projecting electrodes 202*c*, 203*c* ranges from 30 μm to 70 μm. In case the width W1 of projecting electrodes 202*c*, 203*c* has such value, the light reflected to the front of the plasma display apparatus can be prevented from the reduction of luminance of an image resulting from the blocking of the electrode with a small aperture ratio of the plasma display panel.

The width of the projecting electrode is formed such an extent that the discharge characteristic is not deteriorated for the rising of a luminance, while it may range from 35 μm to 45 μm to obtain the utmost aperture ratio of the panel due to a protrusion.

Further, it is preferable that the gap a of the projecting electrodes 202*c*, 203*c* ranges from 60 μm to 120 μm. In case the gap a of the projecting electrodes 202*c*, 203*c* has such value, generating too much discharges between the projecting electrodes 202*c*, 203*c* over the threshold value can be prevented not to shorten the lifetime of an electrode and a proper firing voltage can be obtained in plasma display panel driving.

That is, an over discharge or a weak discharge can be prevented when the over discharges is generated due to a small gap while the weak discharge is generated due to a remote gap, and the aperture ratio of the panel can be fully obtained.

The bridge electrode 202*d*, 203*d* connects two electrode lines 202*a* and 202*b*, 203*a* and 203*b* which form the sustain electrode 202, 203 respectively. The bridge electrode 202*d*, 203*d* helps the discharge generated through projecting electrodes 202*c*, 203*c* to be easily diffused to the electrode lines 202*b*, 203*b* which are far from the center of the discharge cell.

As to the electrode structure according to the first embodiment of the present invention, the number of electrode lines can be suggested like that, thereby, the aperture ratio can be improved. Further, the firing voltage can be lowered by forming projecting electrodes 202*c*, 203*c*. Further, the discharge diffusion efficiency is increased with electrode lines 202*b*, 203*b* and bridge electrodes 202*d*, 203*d* when electrode lines 202*b*, 203*b* are far from the center of the discharge cell. The luminous efficiency of the plasma display panel, as a whole, can be improved. That is, the brightness of the present invention is equal to the brightness of the conventional plasma display panel or brighter than the brightness of the conventional plasma display panel. Therefore, it is possible not to use an ITO transparent electrode.

Figure 5:
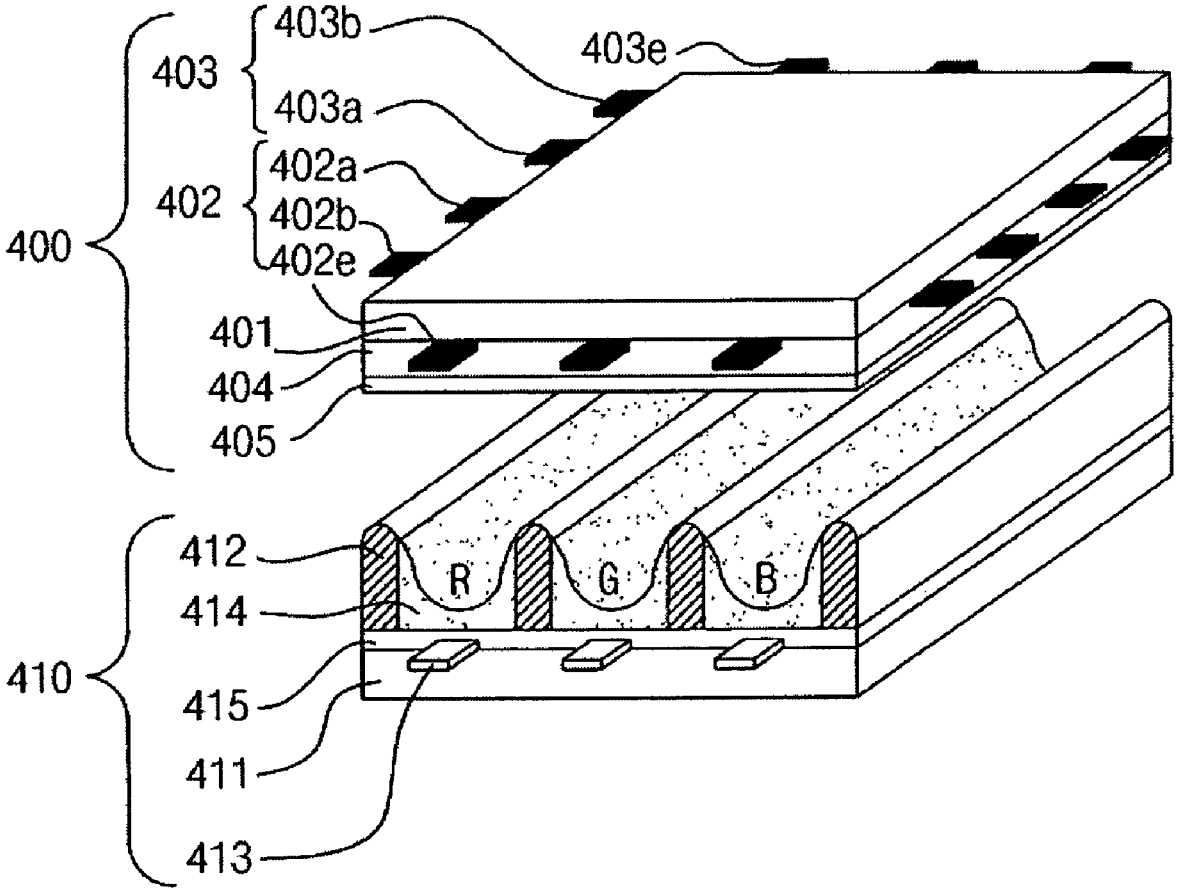
FIG. 5 is a perspective view showing a second embodiment of a plasma display panel according to the present invention.

FIG. 5 is a perspective drawing showing a second embodiment of a plasma display panel according to the present invention.

As shown in FIG. 5, the second embodiment of the plasma display panel according to the present invention includes a front panel 400 and a rear panel 410 which are coalesced each other with a predetermined gap, a barrier rib 412. The address electrode 413 is formed in the rear panel 410 in the direction intersecting with a sustain electrode pair 402, 403, while the barrier rib 412 partitions off a plurality of discharge cells. Here, the same description of the content described in the first embodiment among the features of the present invention of the plasma display panel according to the second embodiment of the present invention will be omitted.

It is preferable that the sustain electrode pair 402, 403 according to the second embodiment of the present invention are made of only an opaque metal electrode. Accordingly, the manufacturing cost of the plasma display panel can be lowered. That is, it is preferable that each sustain electrode pair 402, 403 of the plasma display panel according to the present invention does not include the conventional ITO electrode, but made of one layer with the sole bus electrode.

For example, it is preferable that each sustain electrode pair 402, 203 according to the embodiment of the present invention is made of silver. It is preferable that the silver has a photosensitivity characteristic. Further, as to the sustain electrode pair 402, 403 according to the embodiment of the present invention, it is preferable that the color of which is more dark than that of the front dielectric layer 404 formed in the front substrate 401, and the permeability of the light is more low.

FIG. 5 shows the unit discharge cell R, G, B. Considering the aperture ratio and the discharge diffusion efficiency, the sustain electrode 402, 403 is formed in one discharge cell with a plurality of electrode lines. Further, in the second embodiment of the present invention, provided is the second projecting electrode 402*e*, 403*e* extended to the opposite direction of the center of the discharge cell, such that the discharge efficiency can be improved than the first embodiment of the present invention.

The structure illustrated in FIG. 5 is just an embodiment of the structure of the plasma panel according to the present invention. Therefore, the present invention is not restricted to the plasma display panel structure illustrated in FIG. 5.

The detailed description on the structure of the sustain electrode pair 402, 403 according to the second embodiment of the present invention shown in FIG. 5 will be described in FIG. 6 to FIG. 8.

Figure 6A:
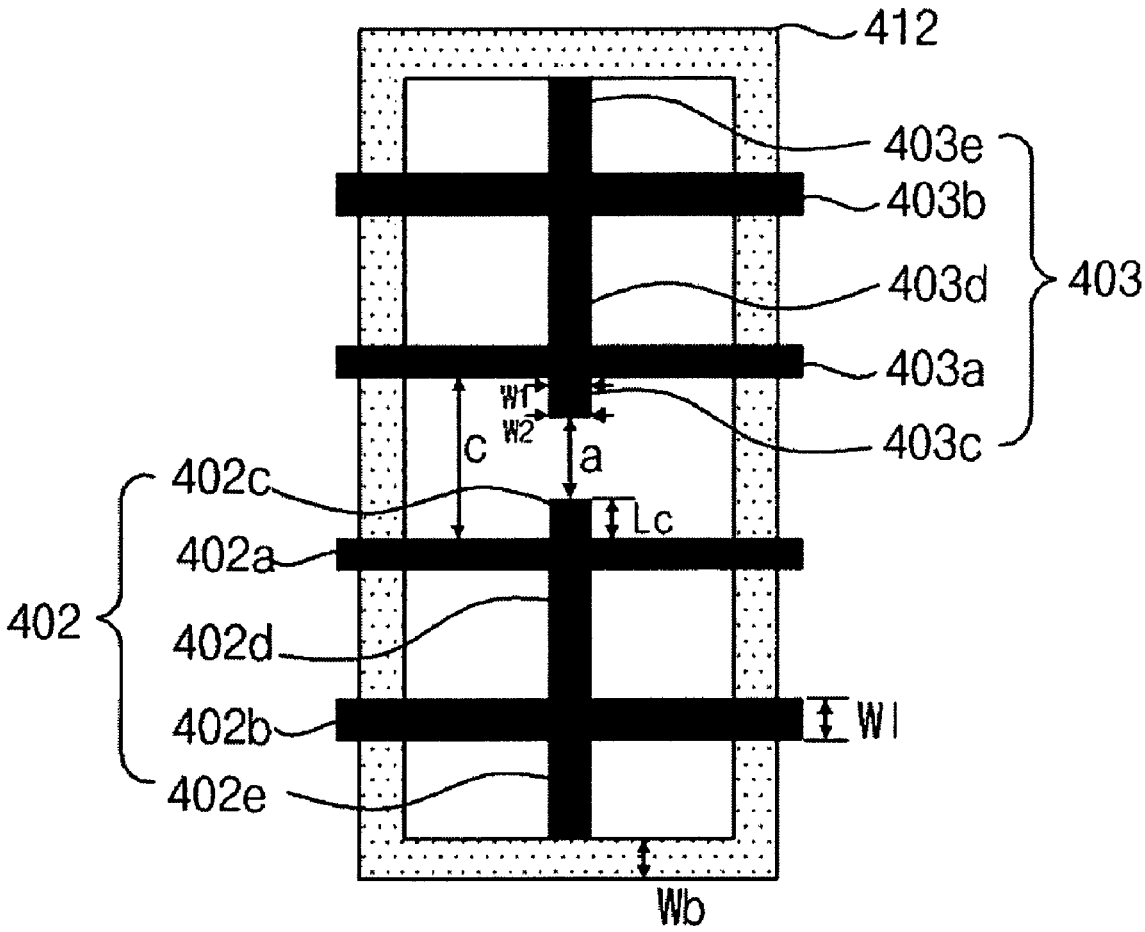
FIG. 6*a* to FIG. 15*b* are a cross-sectional view showing embodiments of the electrode structure of a plasma display panel according to the present invention.
Figure 6B:
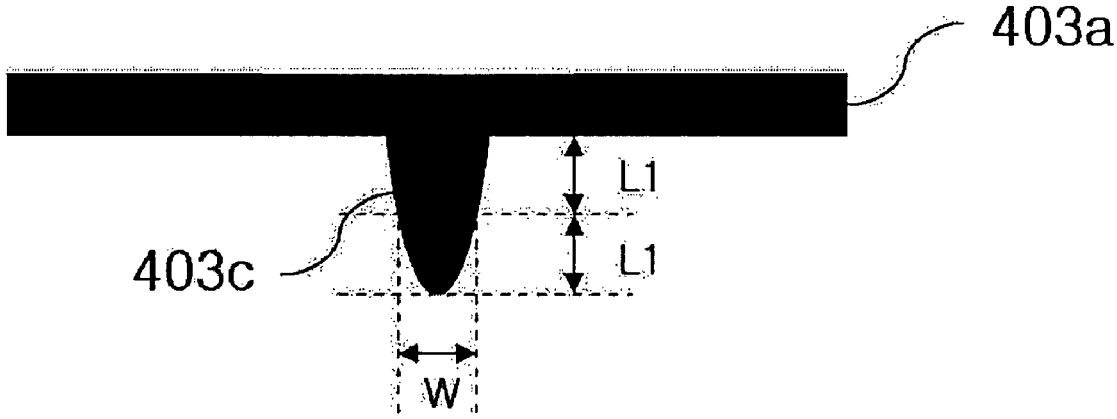

FIG. 6*a* to FIG. 6*b* is a cross-sectional view showing a second embodiment of the electrode structure of a plasma display panel according to the present invention, briefly showing only the layout structure of the sustain electrode pair 402, 403 formed in one discharge cell in the plasma display panel shown in FIG. 5.

As shown in FIG. 6*a*, each sustain electrode 402, 403 is comprised of at least two electrode lines 402*a*, 402*b*, 403*a*, 403*b* crossing the discharge cell, a first projecting electrode 402*c*, 403*c* which is protruded to the center of the discharge cell in the discharge cell and connected to the electrode line 402*a*, 403*a* which is the closest to the center of the discharge cell, a bridge electrode 402*d*, 403*d* connecting the two electrode lines 402*a* and 402*b*, 403*a* and 403*b*, and a second projecting electrode 402*e*, 403*e* which is protruded in the opposite direction of the center of the discharge cell in the discharge cell and connected to the electrode line 402*b*, 403*b* which is most far from the center of the discharge cell.

The electrode lines 402*a*, 402*b*, 403*a*, 403*b* cross the discharge cell, and extending to the direction of the plasma display panel. It is preferable that the electrode line according to the second embodiment of the present invention narrowly forms a width so as to improve the aperture ratio. Preferably, the width of electrode line ranges from 20 μm to 70 μm to improve the aperture ratio and easily generate a discharge.

As shown in FIG. 6*a*, the electrode line 402*a*, 403*a* which is close to the center of the discharge cell is connected to the first projecting electrode 402*c*, 403*c*, forming a path where a discharge diffusion is initiated with the beginning of the discharge. The electrode line 402*b*, 403*b* which is far from the center of the discharge cell is connected to the second projecting electrode 402*e*, 403*e*. The electrode line 402*b*, 403*b* which is far from the center of the discharge cell plays the role of diffusing a discharge to the peripheral of the discharge cell.

The first projecting electrode 402*c*, 403*c* is connected to the electrode line 402*a*, 403*a* which is close to the center of the discharge cell in one discharge cell, and protruding to the center of the discharge cell. Preferably, the first projecting electrode 402*c*, 403*c* is formed in the center of the electrode line 402*a*, 403*a*. The first projecting electrode 402*c*, 403*c* can effectively lower the firing voltage of the plasma display panel with forming in the center of the electrode line 402*a*, 403*a*.

It is preferable that the width W1 of the projecting electrode 402*c*, 403*c* ranges from 30 μm to 70 μm, while the gap between the projecting electrodes 402*c*, 403*c* ranges from 60 μm to 120 μm. The critical meaning of the upper limit value and the lower limit value of the width and the gap of the projecting electrode 402*c*, 403*c* will be omitted since it is identical with the description illustrated in FIG. 4.

The bridge electrodes 402*d*, 403*d* connect two electrode lines 402*a* and 402*b*, 403*a* and 403*b* forming the sustain electrode 402, 403 respectively. The bridge electrode 402*d*, 403*d* helps the generated discharge to be easily diffused to the center of the discharge cell and the remote electrode line 402*b*, 403*b* through the projecting electrode. Here, bridge electrode 402*d*, 403*d* is positioned in the discharge cell, however, if necessary, it can be formed on the barrier rib 412 partitioning off the discharge cell.

Accordingly, in the second embodiment of the electrode structure of the plasma display panel according to the present invention, a discharge can be diffused to the space between the electrode line 402*b*, 403*b* and the barrier rib 412. Therefore, the luminous efficiency of the plasma display panel can be improved by increasing the discharge diffusion efficiency.

The second projecting electrodes 402*e*, 403*e* are connected to the electrode line 402*b*, 403*b* which is far from the center of the discharge cell, and protruding to the opposite direction of the center of the discharge cell it is preferable that the length of the second projecting electrode 402*e*, 403*e* ranges from 30 μm to 100 μm.

Thus, a discharge can be effectively diffused to the discharge space which is far from the center of the discharge cell, while the aperture ratio of the panel is maintained with 25% to 45%, thereby the luminance of the display image can be improved.

In this way, in the present invention, it is preferable that the aperture ratio of the plasma display panel according to the present invention ranges from 25% to 45% so as to improve the luminance of the display image and the contrast, and to obtain the resistance value of the electrode for obtaining the drive margin of the drive panel.

At this time, it is preferable that the aperture ratio of the panel is an aperture ratio by contrast with the effective display region of a panel, that is, the region where the discharge cells which has an effect on the display image among the discharge cells of the panel are positioned.

As shown in FIG. 6*a*, the second projecting electrode 402*e*, 403*e* can be extended to the barrier rib 412 partitioning off the discharge cell. In addition, if the aperture ratio can be fully compensated in the other part, the second projecting electrode 402*e*, 403*e* can be partly extend on the barrier rib 412 so as to much more improve the discharge diffusion efficiency.

However, in case the second projecting electrode 402*e*, 403*e* is not extended to the barrier rib 412, it is preferable that the gap between the second projecting electrode 402*e*, 403*e* and the barrier rib 412 which is adjacent to the second projecting electrode 402*e*, 403*e* is 70 μm or less.

When the gap between the second projecting electrode 402*e*, 403*e* and the barrier rib 412 is 70 μm or less, a discharge can be diffused effectively to the discharge space which is far from the center of the discharge cell.

It is preferable that, in the second embodiment of the present invention, the second projecting electrode 402*e*, 403*e* is formed in the center of electrode line 402*b*, 403*b* to evenly diffuse a discharge over the peripheral of the discharge cell.

In the meantime, in the second embodiment of the present invention, it is preferable that the width Wb of the barrier rib positioned in the direction to which the second projecting electrode 402*e*, 403*e* is extended among the barrier ribs partitioning off the discharge cell is 200 μm or less.

In addition, it is preferable that a black matrix (not shown) for absorbing the external light to obtain the bright room contrast and preventing the emitted discharge light from being diffused throughout the neighboring discharge cell to display is formed on the barrier rib 412.

The width of the barrier rib 412 is suggested to be 200 μm or less, thereby, the region of the discharge cell is increased. Accordingly, the luminous efficiency can be increased, and the reduction of the aperture ratio due to the second projecting electrode can be compensated. Preferably, the width Wb of the barrier rib positioned in the direction to which the second projecting electrode is extended ranges from 90 μm to 100 μm to obtain the optimum luminous efficiency.

Further, referring to FIG. 6*b*, the protrusion 403*c* can include a curved portion having a curvature. As shown in FIG. 6*b*, in case the protrusion 403*c* is formed with a curve shape, the manufacturing process of the electrode can be more facilitated. In addition, such shape can prevent the wall charges from being excessively concentrated on a specific location in driving the panel. Accordingly, the discharge characteristic is stabilized, and the driving stability can be improved.

As shown in FIG. 6*b*, in case the protrusion 403*c* is formed with a curve shape, it is preferable that the width W of the protrusion 403*c* is defined as the width of the center portion of the protrusion 403*c*. In addition, the portion in which the bridge electrode 402*d*, 403*d* and the electrode line 402*a*, 403*a* are connected has a curvature like the protrusion 403*c* shown in FIG. 5*b*.

Figure 7:
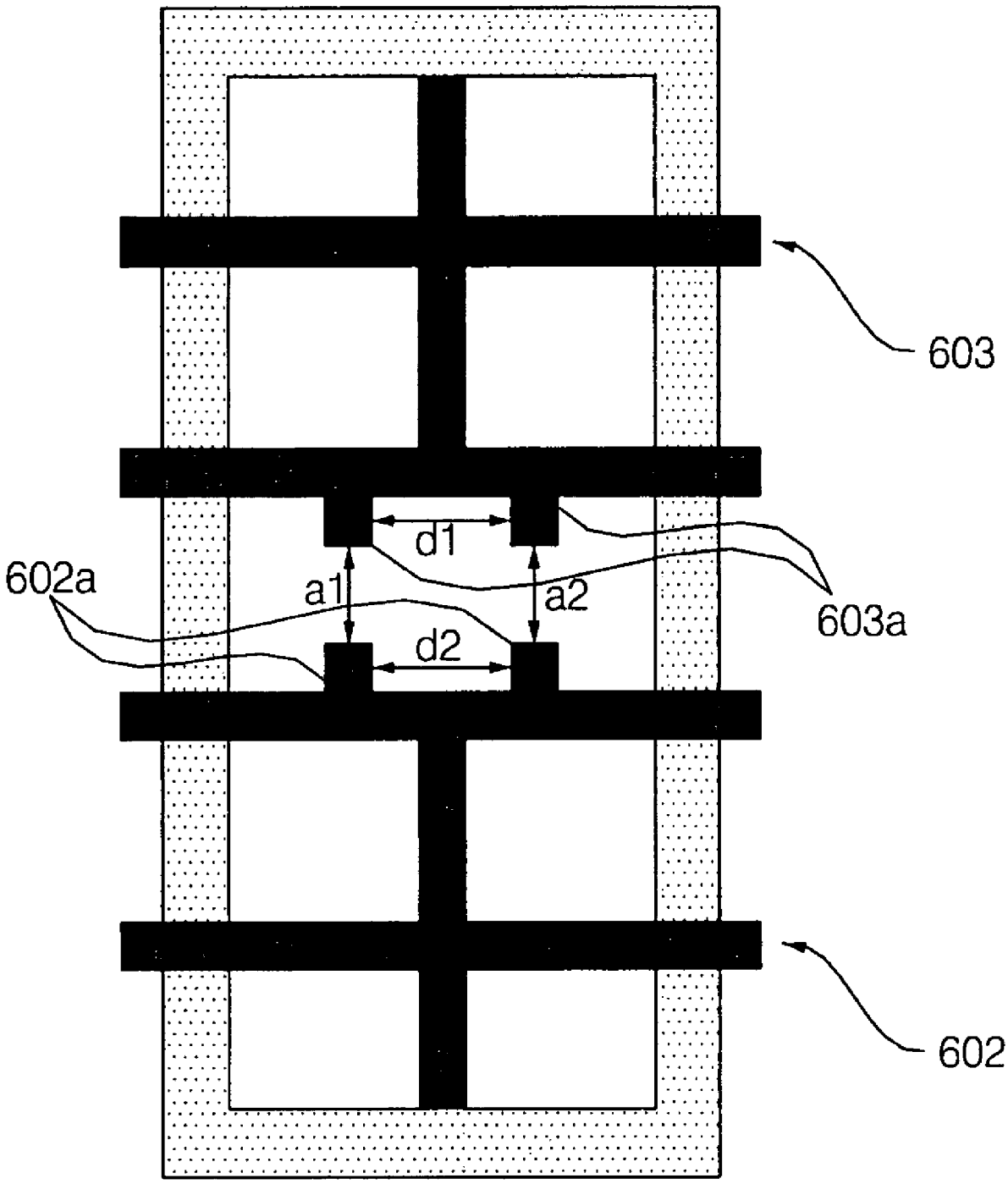

FIG. 7 is a cross-sectional view showing a third embodiment of the electrode structure of a plasma display panel according to the present invention. The same description described in FIG. 6 among the electrode structure shown in FIG. 7 will be omitted.

As shown in FIG. 7, in the third embodiment of the electrode structure according to the present invention, two first projecting electrodes 602*a*, 603*a* are formed in the sustain electrode 602, 603 respectively. The first projecting electrodes 602*a*, 603*a* are connected to the electrode line which is close to the center of the discharge cell, and protruding to the direction of the center of the discharge cell. Preferably, each first projecting electrodes 602*a*, 603*a* is symmetrized based on the center of the electrode line to be formed.

It is preferable that the width of the first projecting electrodes 602*a*, 603*a* ranges from 30 μm to 70 μm. The critical meaning of the upper limit value and the lower limit value of the width of the projecting electrodes will be omitted since it is identical with the description illustrated in FIG. 4.

It is preferable that the gap d1, d2 of the first projecting electrodes protruded from one electrode line ranges from 50 μm to 100 μm in case the plasma display panel has the size of 42 inch with the resolution of VGA. In case the plasma display panel has the size of 42 inch with the resolution of XGA, it is preferable that the gap d1, d2 of the first projecting electrode ranges from 30 μm to 80 μm. In case the plasma display panel has the size of 50 inch with the resolution of XGA, it is preferable that the gap d1, d2 of the first projecting electrode ranges from 40 μm to 90 μm.

When the gap d1, d2 of the first projecting electrode has such range, the aperture ratio capable of implementing the luminance of the image required for the display device can be obtained. Also, the power used up in displaying can be prevented from being increased over the threshold level, when the power is increased as the reactive power due to the first projecting electrode which is so close to the barrier rib is increased.

Two first projecting electrodes 602*a*, 603*a* are formed on the sustain electrode 602, 603 such that the electrode region in the center of the discharge cell is increased. Accordingly, before a discharge is generated, the space charge is very much formed in the discharge cell, thereby, the firing voltage is more decreased, and the discharge rate is increased. Additionally, after the discharge is generated, the amount of wall charges are increased such that the luminance rises, and the discharge is uniformly diffused throughout the whole discharge cell.

It is preferable that the gap a1, a2 of the first projecting electrodes 602*c*, 603*c*, that is, the gap of two projecting electrodes in the direction intersecting with the electrode line 602, 603 ranges from 60 μm to 120 μm. The critical meaning of the upper limit value and the lower limit value of the gap of the projecting electrodes will be omitted since it is identical with the description illustrated in FIG. 4.

In the meantime, at least one of the projecting electrodes can include a portion having a curvature. For example, the end of the projecting electrode may have the shape of a curve, while the projecting electrode may have a curvature in the portion where the bridge electrode and the line electrode are adjacent. In that case, the minute shape of the projecting electrode may be readily manufactured in the manufacturing process. The discharge characteristic will be able to be improved due to the soft end processing. Additionally, in driving the PDP, the wall charges can be prevented from being excessively concentrated on a specific location. Accordingly the discharge characteristic is stabilized and the driving stability can be improved.

Figure 8:
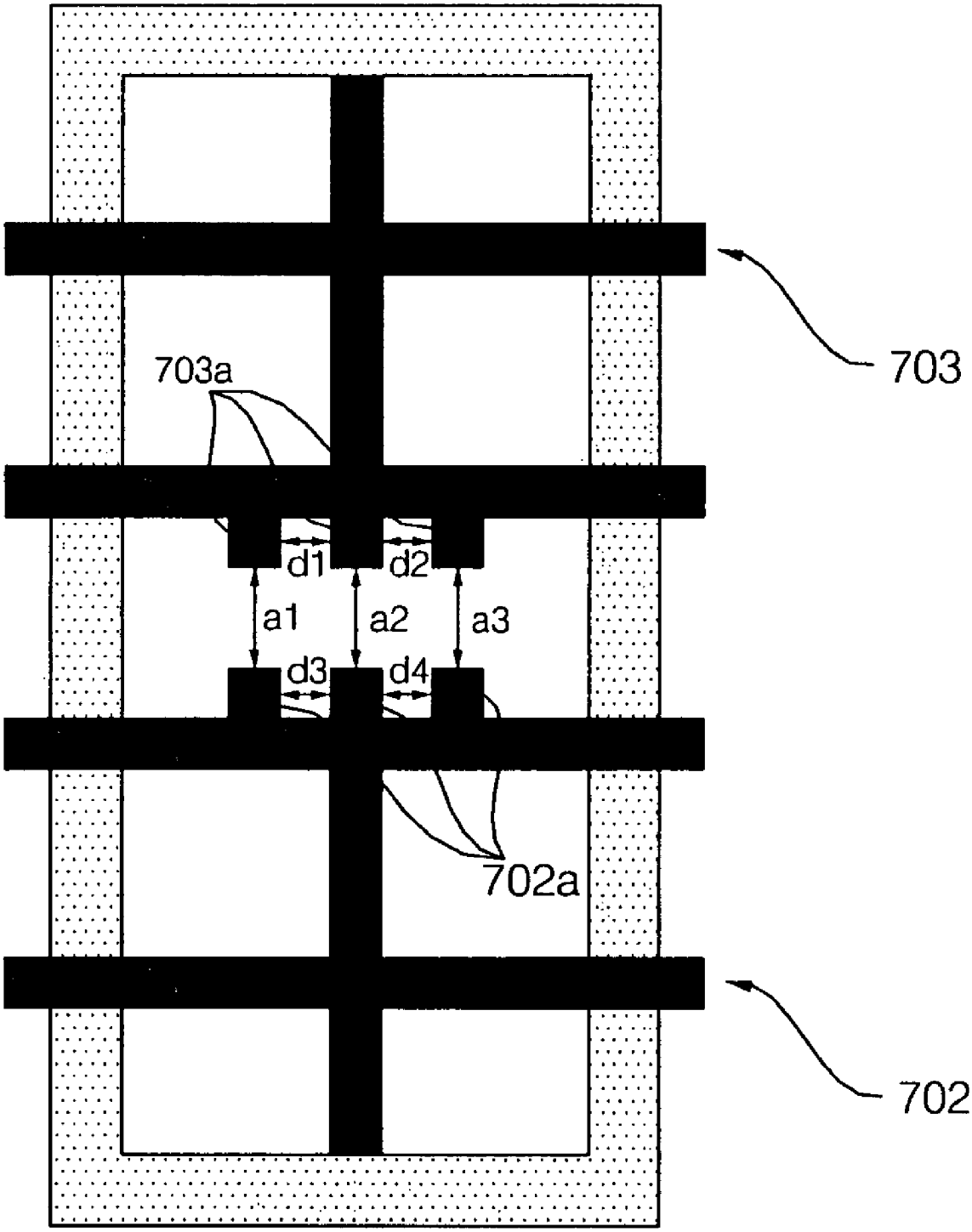

FIG. 8 is a cross-sectional view showing a fourth embodiment of the electrode structure of a plasma display panel according to the present invention. The same description described in FIG. 6, FIG. 7 among the electrode structure shown in FIG. 8 will be omitted.

As shown in FIG. 8, in the fourth embodiment of the electrode structure according to the present invention, three first projecting electrodes 702*a*, 703*a* are formed in the sustain electrode 702, 703 respectively.

The first projecting electrodes 702*a*, 703*a* are connected to the electrode line which is close to the center of the discharge cell, and protruding to the direction of the center of the discharge cell. Preferably, one of first projecting electrodes is formed in the center of the discharge cell, and the other, two electrodes, are symmetrized based on the center of the electrode line to be formed.

Three first projecting electrodes 702*a* 703*a* are formed on the sustain electrode 702, 703 respectively. Thus, the firing voltage is much more decreased than FIG. 6*a* and FIG. 7, and the discharge rate is much more increased. Additionally, after a discharge is generated, the luminance is much more increased, and the discharge is more uniformly diffused throughout the whole discharge cell.

As described in the above, by increasing the number of the first projecting electrode, the electrode region in the center of the discharge cell increases such that the firing voltage is decreased and a luminance increases. On the other hand, it should be considered that the brightest discharge light is emitted while the strongest discharge occurs in the center of the discharge cell. That is, by blocking the light emitted in the center of the discharge cell as the number of the first projecting electrode increases, the emitted light remarkedly reduces. Furthermore, additionally considering the firing voltage and the luminous efficiency at the same time, the most optimal number is selected to design the structure of the sustain electrode.

It is preferable that the width of the first projecting electrodes 702*a*, 703*a* ranges from 30 μm to 70 μm, while the gap a1, a2, a3 of the first projecting electrodes 702*c*, 703*c* ranges from 60 μm to 120 μm. The critical meaning of the upper limit value and the lower limit value of the gap and the width of the projecting electrodes will be omitted since it is identical with the description illustrated in FIG. 4.

Figure 9:
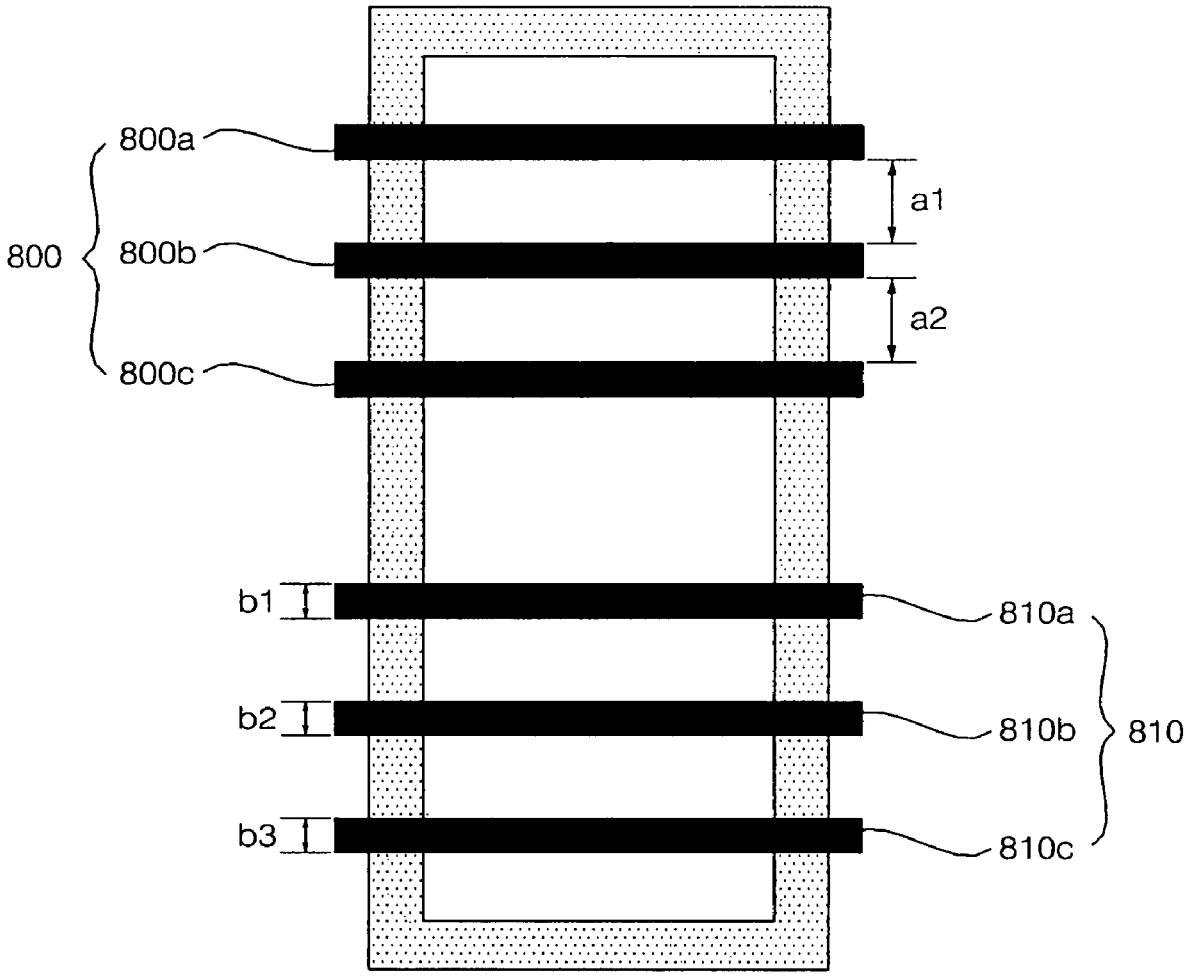

FIG. 9 is a cross-sectional view showing a fifth embodiment of the electrode structure of a plasma display panel according to the present invention.

Each sustain electrode 800, 810 includes three electrode lines 800*a*, 800*b*, 800*c*, 810*a*, 810*b*, 810*c* crossing the discharge cell. The electrode lines are extended to one direction of the plasma display panel with crossing the discharge cell. The width of the electrode lines is narrowly formed to increase the aperture ratio. Preferably, the width of the electrode lines ranges from 20 μm to 70 μm such that the aperture ratio can be improved and a discharge can be smoothly occurred.

It is preferable that the thickness of the electrode lines 800*a*, 800*b*, 800*c*, 810*a*, 810*b*, 810*c* of the sustain electrode pair ranges from 3 μm to 7 μm. The gap a1, a2 of the electrode lines of three electrode lines forming the sustain electrode can be identical or different, while the width b1, b2, b3 of the electrode lines can be identical or different.

Figure 10:
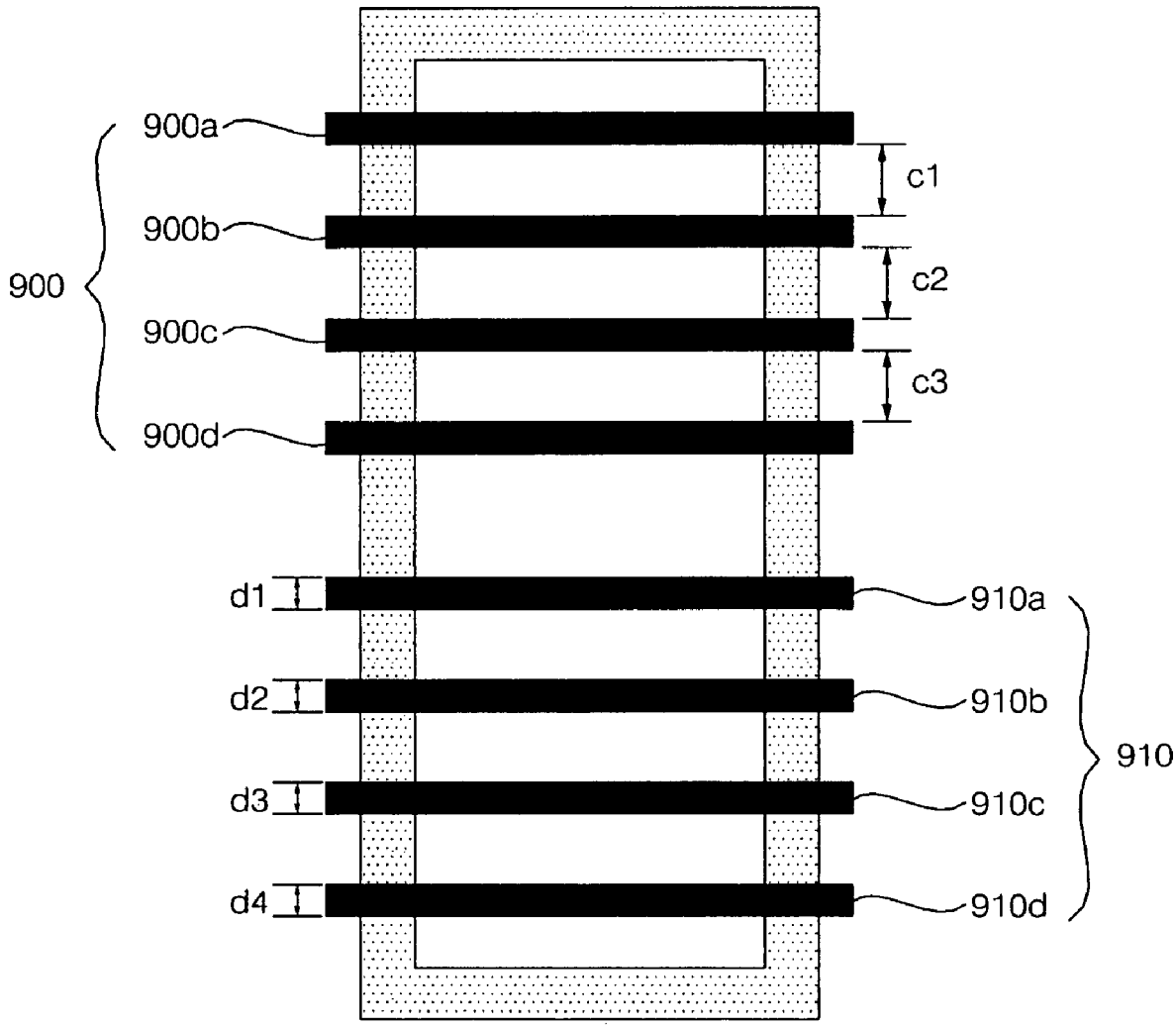

FIG. 10 is a cross-sectional view showing a sixth embodiment of the electrode structure of a plasma display panel according to the present invention.

Each sustain electrode 900, 910 includes four electrode lines 900*a*, 900*b*, 900*c*, 900*d*, 910*a*, 910*b*, 910*c*, 910*d* crossing the discharge cell. The electrode lines are extended to one direction of the plasma display panel with crossing the discharge cell. The width of the electrode lines is narrowly formed to increase the aperture ratio. Preferably, the width of the electrode lines ranges from 20 μm to 70 μm such that the aperture ratio can be improved and a discharge can be smoothly occurred.

It is preferable that the thickness of the electrode lines 900*a*, 900*b*, 900*c*, 900*d*, 910*a*, 910*b*, 910*c*, 910*d* of the sustain electrode pair ranges from 3 μm to 7 μm. The critical meaning of the upper limit value and the lower limit value of the thickness of the electrode lines will be omitted since it is identical with the description illustrated in FIG. 2.

The gap c1, c2, c3 of the electrode lines of four electrode lines forming the sustain electrode can be identical or different, while the width d1, d2, d3, d4 of the electrode lines can be identical or different.

Figure 11:
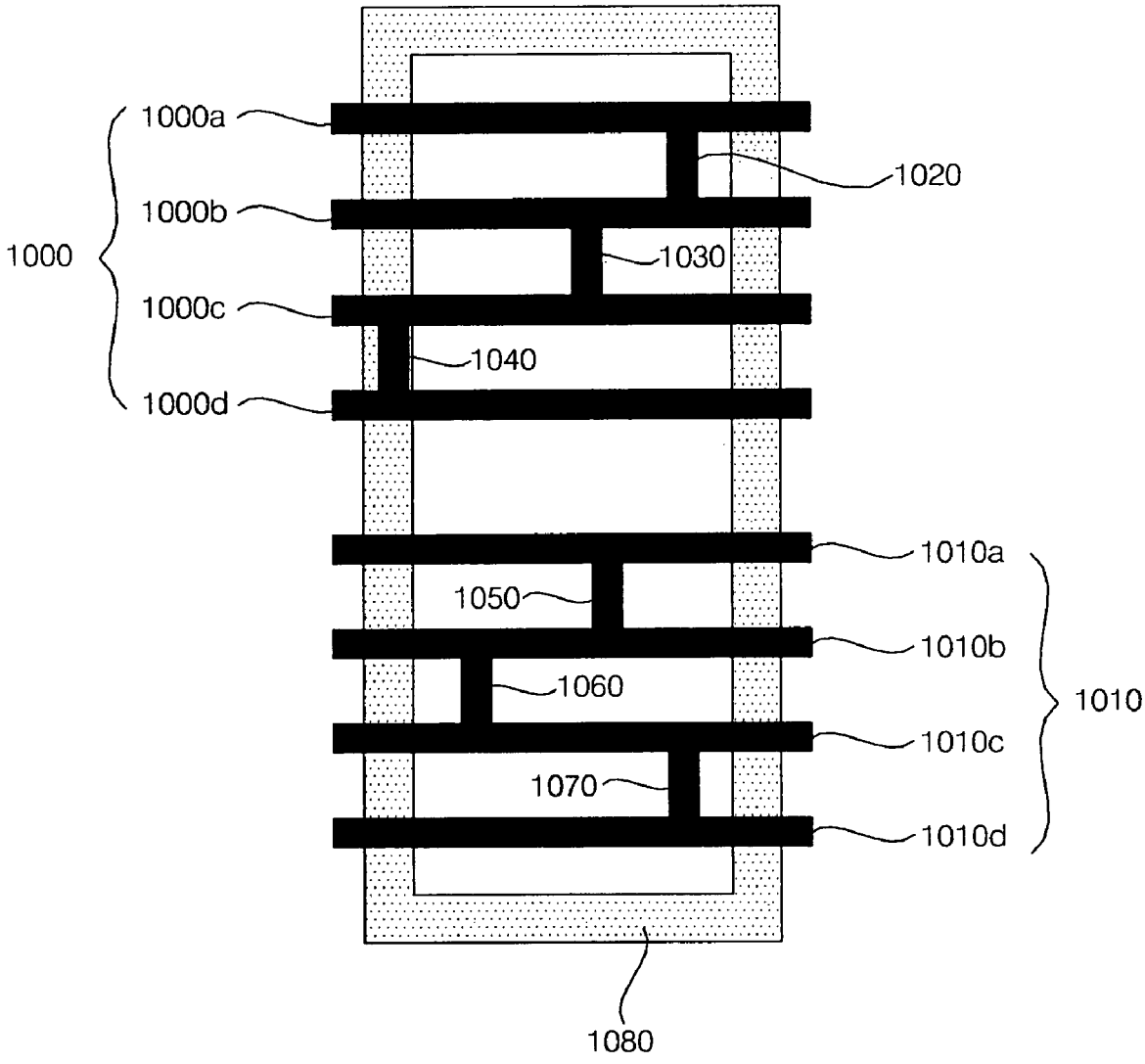

FIG. 11 is a cross-sectional view showing a seventh embodiment of the electrode structure of a plasma display panel according to the present invention.

Each sustain electrode 1000, 1010 includes four electrode lines 1000*a*, 1000*b*, 1000*c*, 1000*d*, 1010*a*, 1101*b*, 1010*c*, 1010*d* crossing the discharge cell. The electrode lines are extended to one direction of the plasma display panel with crossing the discharge cell. It is preferable that the thickness of the electrode lines 1000*a*, 1000*b*, 1000*c*, 1000*d*, 1010*a*, 1101*b*, 1010*c*, 1010*d* of the sustain electrode pair ranges from 3 μm to 7 μm. The critical meaning of the upper limit value and the lower limit value of the thickness of the electrode lines will be omitted since it is identical with the description illustrated in FIG. 2.

The bridge electrodes 1020, 1030, 1040, 1050, 1060, 1070 connect two electrode lines respectively. The bridge electrode 1020, 1030, 1040, 1050, 1060, 1070 helps the generated discharge to be easily diffused to the center of the discharge cell and the remote electrode line. As shown in FIG. 11, the location of the bridge electrodes 1020, 1030, 1040, 1050, 1060, 1070 may not coincide, while one of bridge electrodes 1040 can be positioned on the barrier rib 1080.

Figure 12:
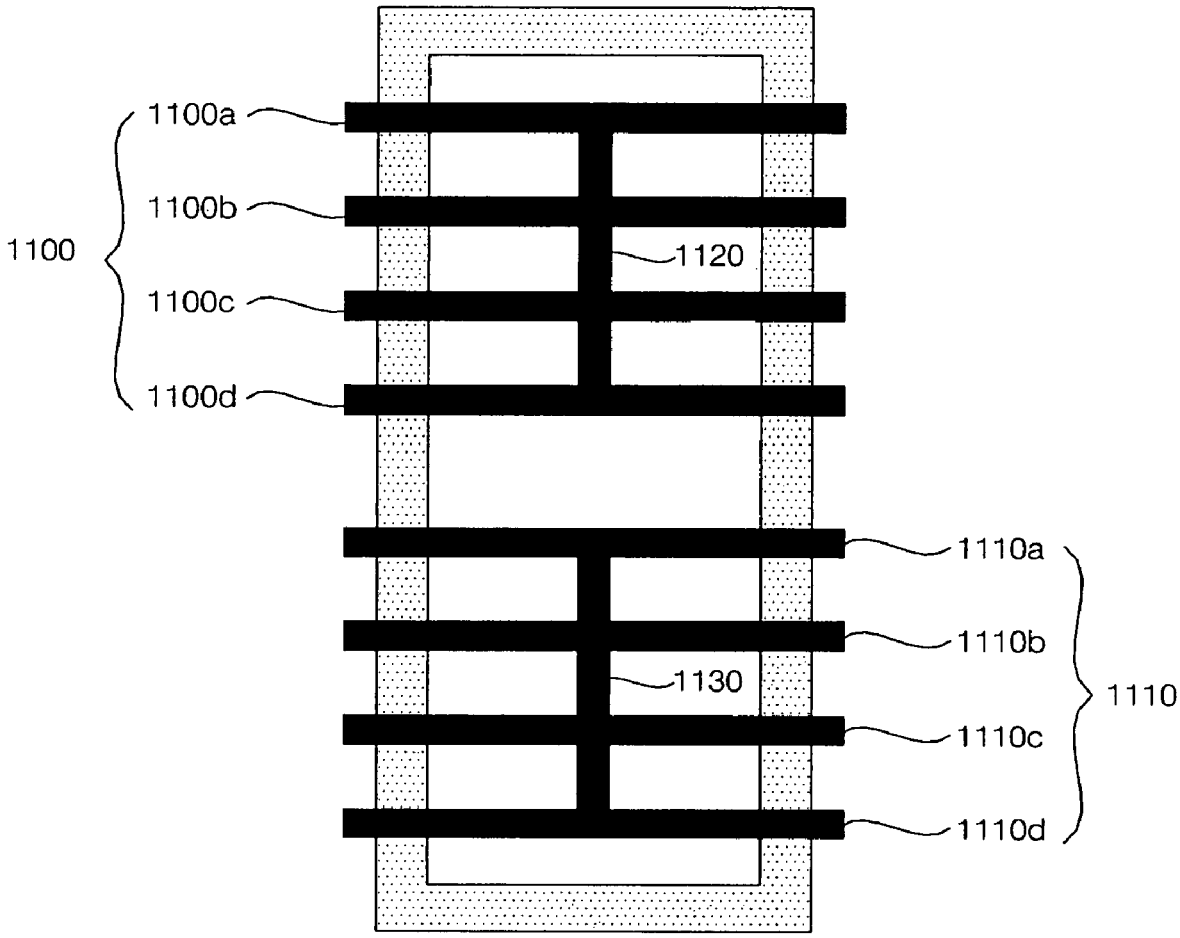

FIG. 12 is a cross-sectional view showing a eighth embodiment of the electrode structure of a plasma display panel according to the present invention. The bridge electrode connecting electrode lines is formed, differently with FIG. 11. That is, one bridge electrode 1120, 1130 connecting four electrode lines 1100*a*, 1100*b*, 1100*c*, 1100*d*, 1110*a*, 1110*b*, 1110*c*, 1110*d* to each sustain electrode 1100, 1110 is formed.

It is preferable that the thickness of the electrode lines 1000*a*, 1000*b*, 1000*c*, 1000*d*, 1010*a*, 1010*b*, 1010*c*, 1010*d* of the sustain electrode pair ranges from 3 μm to 7 μm. The critical meaning of the upper limit value and the lower limit value of the thickness of the electrode lines will be omitted since it is identical with the description illustrated in FIG. 2.

Figure 13:
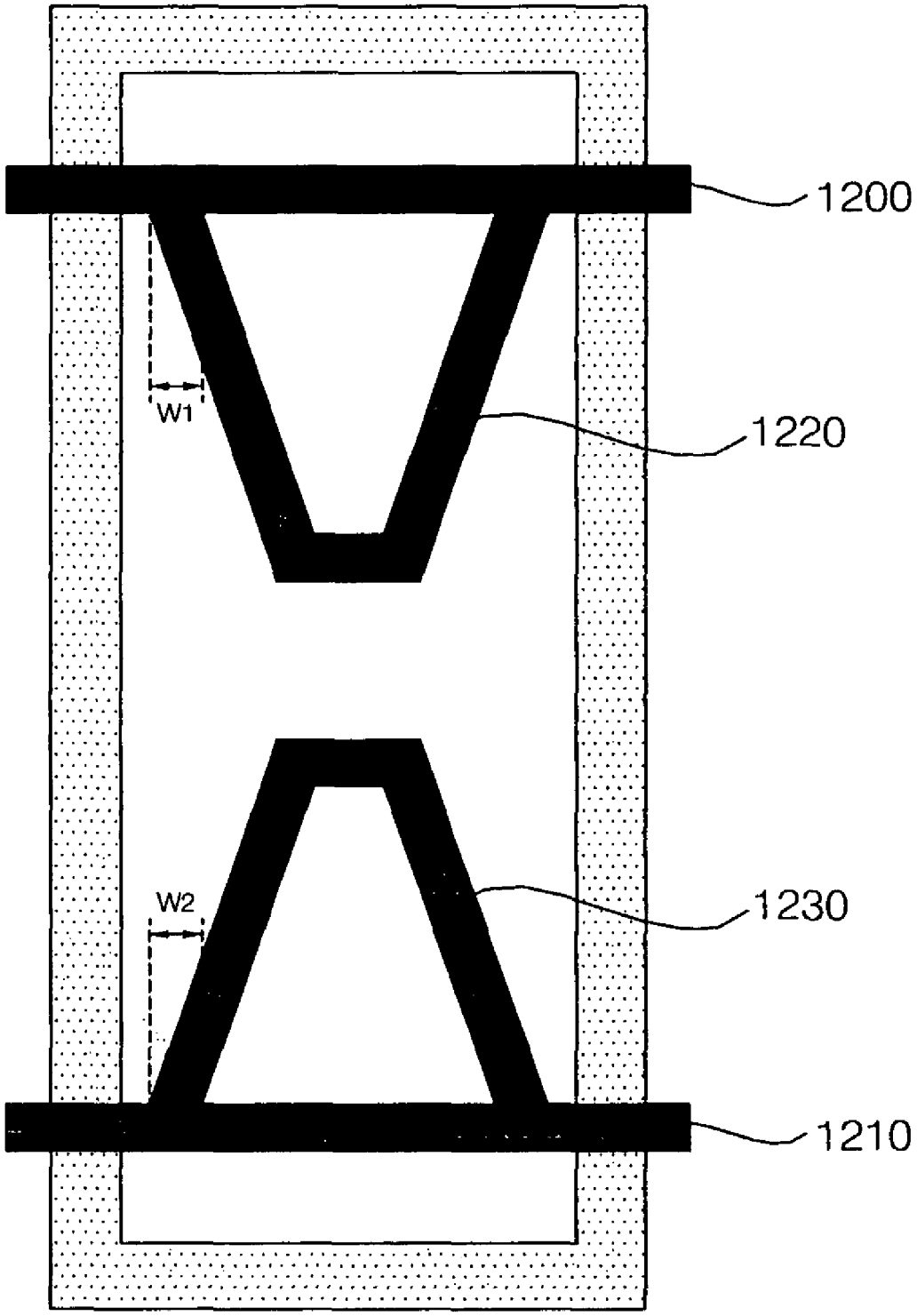

FIG. 13 is a cross-sectional view showing a ninth embodiment of the electrode structure of a plasma display panel according to the present invention.

Projecting electrodes 1220, 1230 including a closed loop for each electrode line 1200, 1210 are formed. The firing voltage can be lowered by projecting electrodes 1220, 1230 including the closed loop as shown in FIG. 13, and, at the same time, the aperture ratio can be improved. The form of the projecting electrode and the closed loop can be variously formed.

It is preferable that the thickness of the electrode lines 1200, 1210 of the sustain electrode pair ranges from 3 μm to 7 μm. The critical meaning of the upper limit value and the lower limit value of the thickness of the electrode lines will be omitted since it is identical with the description illustrated in FIG. 2.

It is preferable that the width W1, W2 of the projecting electrodes 1220, 1230 ranges from 30 μl to 70 μm. In case the width W1, W2 of the projecting electrode 1220, 1230 has such value, by obtaining a sufficient aperture ratio, the light reflected to the front of the plasma display apparatus can be prevented from the reduction of luminance of an image resulting from the blocking of the electrode, It is preferable that the gap of projecting electrode 1220, 1230 ranges from 60 μm to 120 μm. The critical meaning of the upper limit value and the lower limit value of the gap of projecting electrode will be omitted since it is identical with the description illustrated in FIG. 4.

Figure 14:
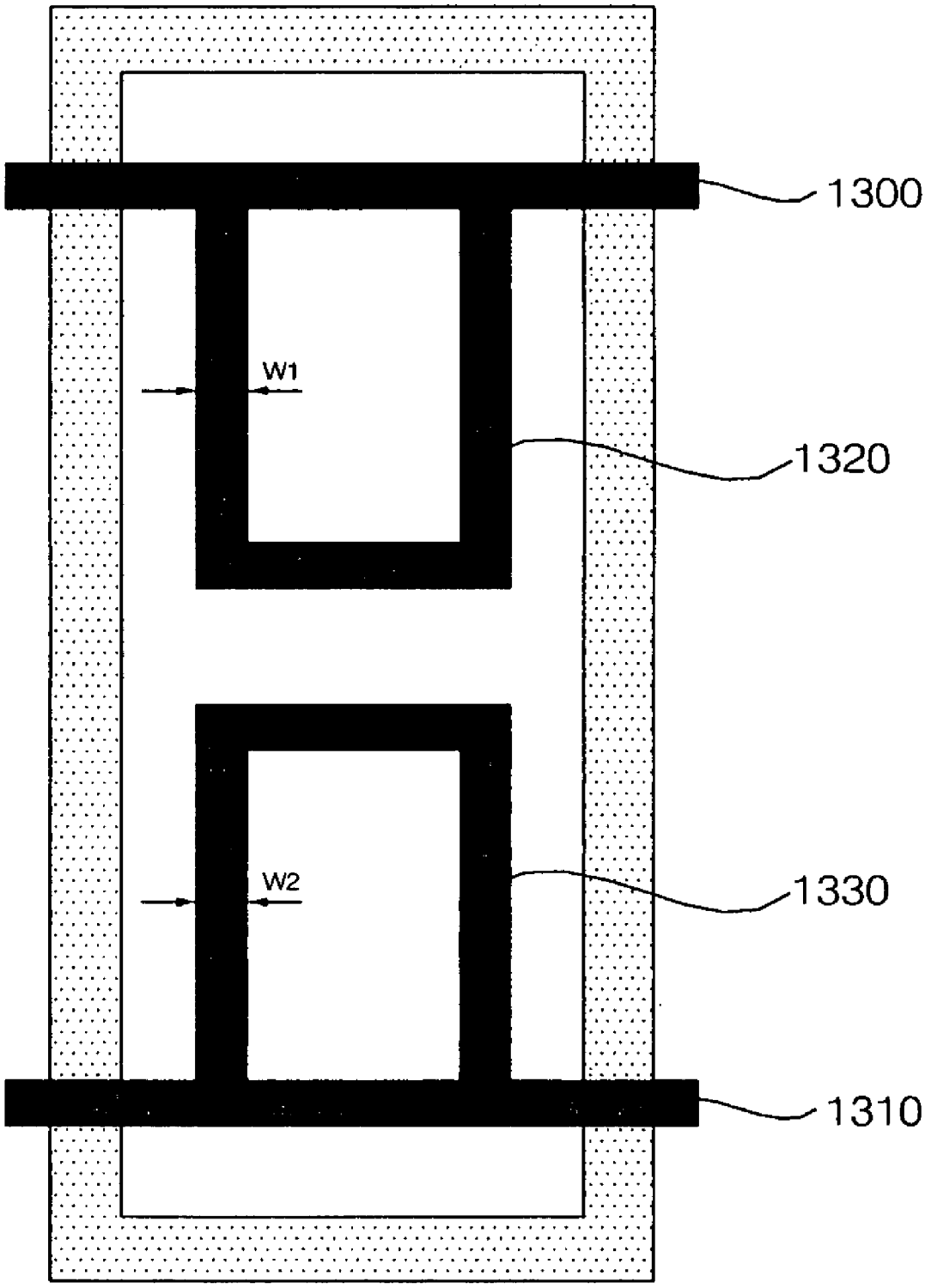

FIG. 14 is a cross-sectional view showing a tenth embodiment of the electrode structure of a plasma display panel according to the present invention.

Projecting electrodes 1320, 1330 including a rectangular loop for each electrode line 1300, 1310 are formed. It is preferable that the thickness of the electrode lines 1320, 1330 of the sustain electrode pair ranges from 3 μm to 7 μm. The critical meaning of the upper limit value and the lower limit value of the thickness of the electrode lines will be omitted since it is identical with the description illustrated in FIG. 2.

It is preferable that the width W1, W2 of the projecting electrodes 1320, 1330 ranges from 30 μm to 70 μm. The critical meaning of the upper limit value and the lower limit value of the width W1, W2 of the projecting electrodes 1320, 1330 will be omitted since it is identical with the description illustrated in FIG. 13.

It is preferable that the gap of projecting electrode 1320, 1330 ranges from 60 μm to 120 μm. The critical meaning of the upper limit value and the lower limit value of the gap of projecting electrode will be omitted since it is identical with the description illustrated in FIG. 4.

Figure 15A:
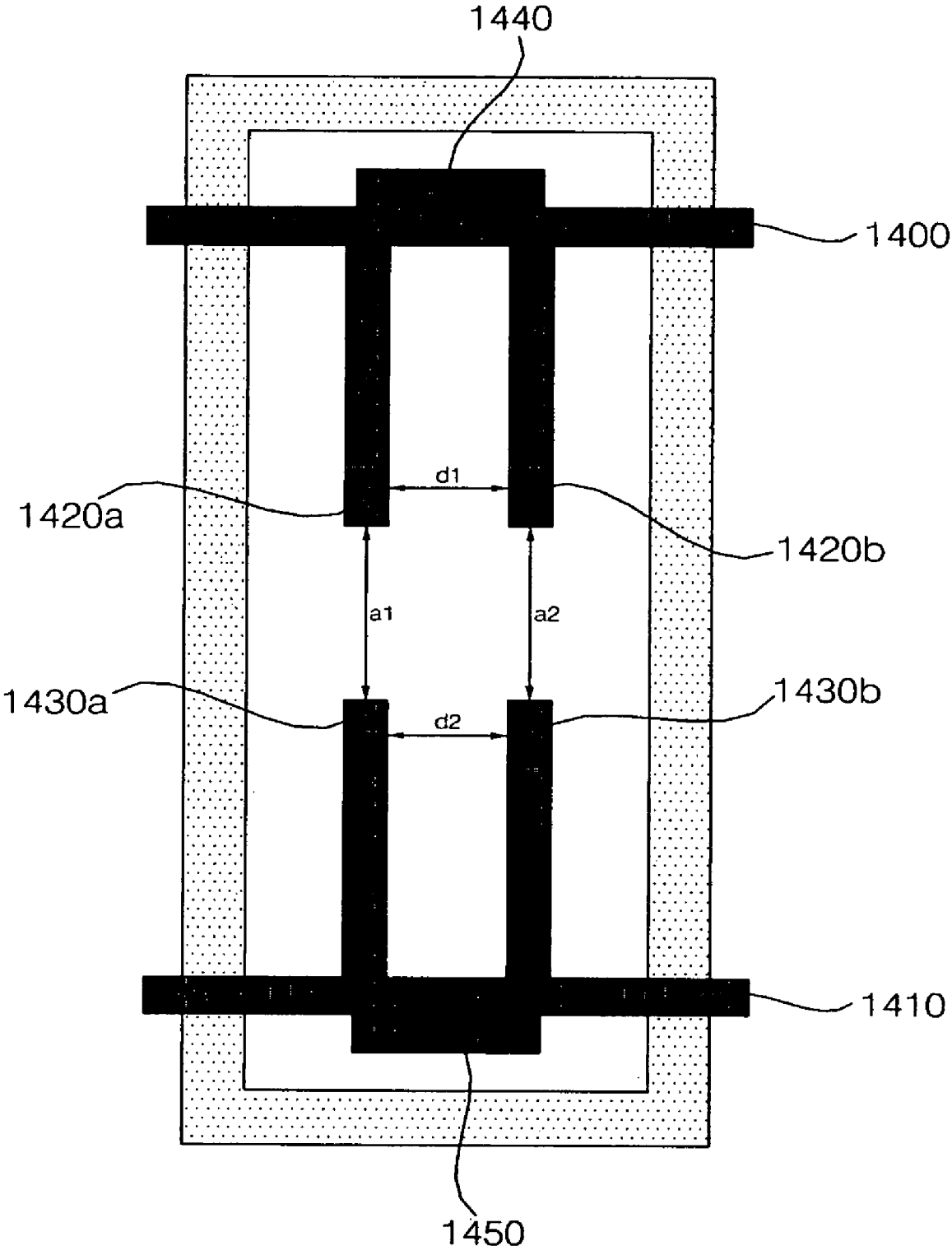
Figure 15B:
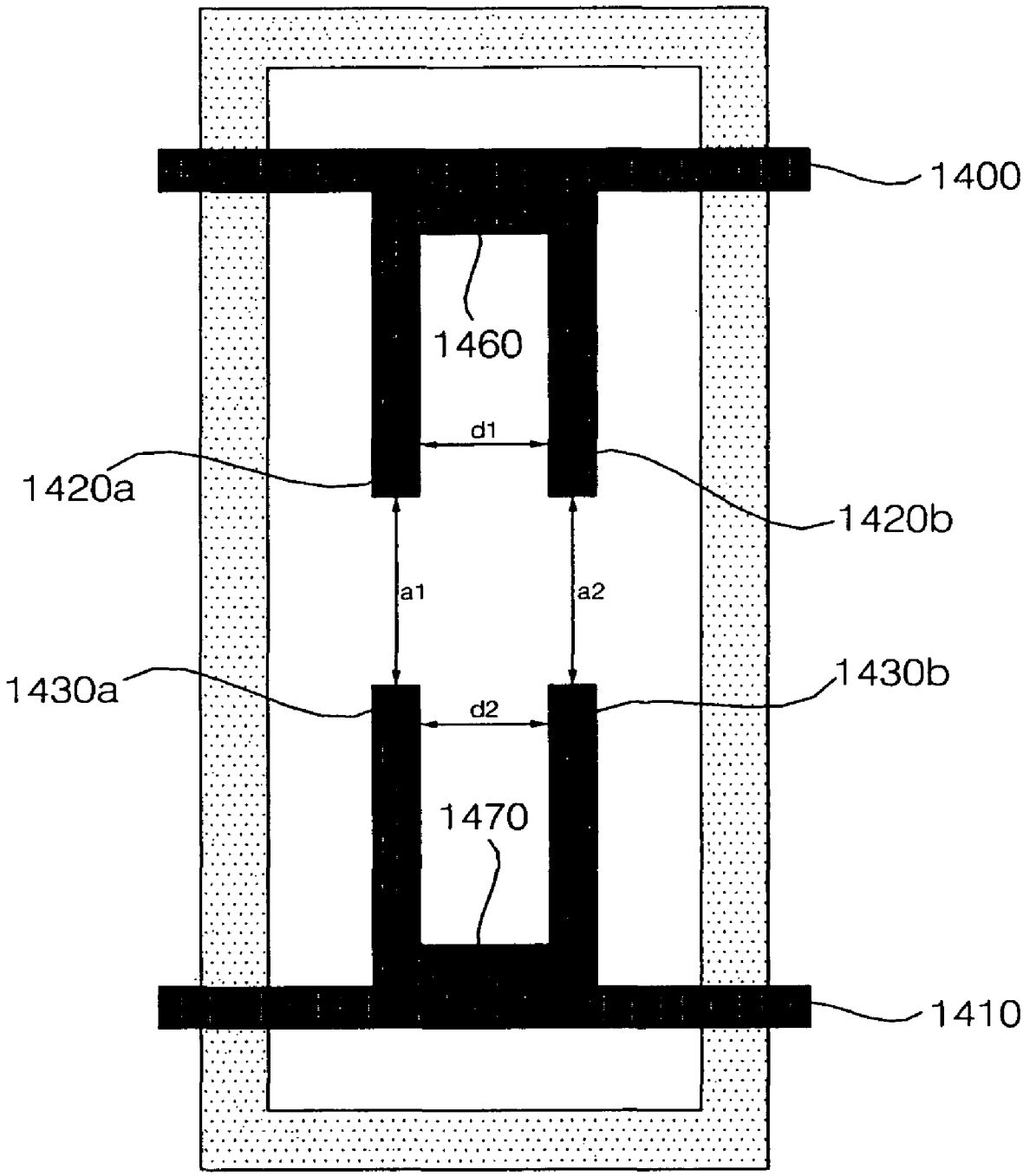

FIG. 15*a* and FIG. 15*b* are a cross-sectional view showing a eleventh embodiment of the electrode structure of a plasma display panel according to the present invention. For each electrode line 1400, 1410, first projecting electrodes 1420*a*, 1420*b*, 1430*a*, 1430*b* protruding to the direction of the center of the discharge cell and second projecting electrodes 1440, 1450, 1460, 1470 protruding to the direction of the center of the discharge cell or in the opposite direction of the center of the discharge cell are formed.

As shown in FIG. 15*a*, it is preferable that, for each electrode line 1400, 1410, two first projecting electrodes 1420*a*, 1420*b*, 1430*a*, 1430*b* protruding to the direction of the center of the discharge cell are formed respectively, while one second projecting electrode 1440, 1450 protruding to the opposite direction of the center of the discharge cell is formed. Further, as shown in FIG. 15*b*, the second projecting electrode 1460, 1470 can be protruded to the center of the discharge cell.

It is preferable that the thickness of the electrode lines 1400, 1410 of the sustain electrode pair ranges from 3 μm to 7 μm. The critical meaning of the upper limit value and the lower limit value of the thickness of the electrode lines will be omitted since it is identical with the description illustrated in FIG. 2.

It is preferable that the width of the first projecting electrodes 1420*a*, 1420*b*, 1430*a*, 1430*b* ranges from 30 μm to 70 μm. The critical meaning of the upper limit value and the lower limit value of the width of the projecting electrodes will be omitted since it is identical with the description illustrated in FIG. 4.

It is preferable that the gap d1, d2 of the two first projecting electrodes protruded from one electrode line ranges from 50 μm to 100 μm in case the plasma display panel has the size of 42 inch with the resolution of VGA. In case the plasma display panel has the size of 42 inch with the resolution of XGA, it is preferable that the gap d1, d2 of the first projecting electrode ranges from 50 μm to 100 μm. In case the plasma display panel has the size of 50 inch with the resolution of XGA, it is preferable that the gap d1, d2 of the first projecting electrode ranges from 40 μm to 90 μm.

The critical meaning of the upper limit value and the lower limit value of the gap d1, d2 of the first projecting electrode will be omitted since it is identical with the description illustrated in FIG. 7.

It is preferable that the gap of another first projecting electrodes, that is, the gap a1 between 1420*a* and 1430*a*, or the gap a2 between 1420*b* and 1430*b* ranges from 60 μm to 120 μm. The critical meaning of the upper limit value and the lower limit value of the gap of the projecting electrodes will be omitted since it is identical with the description illustrated in FIG. 4.

Figure 16A:
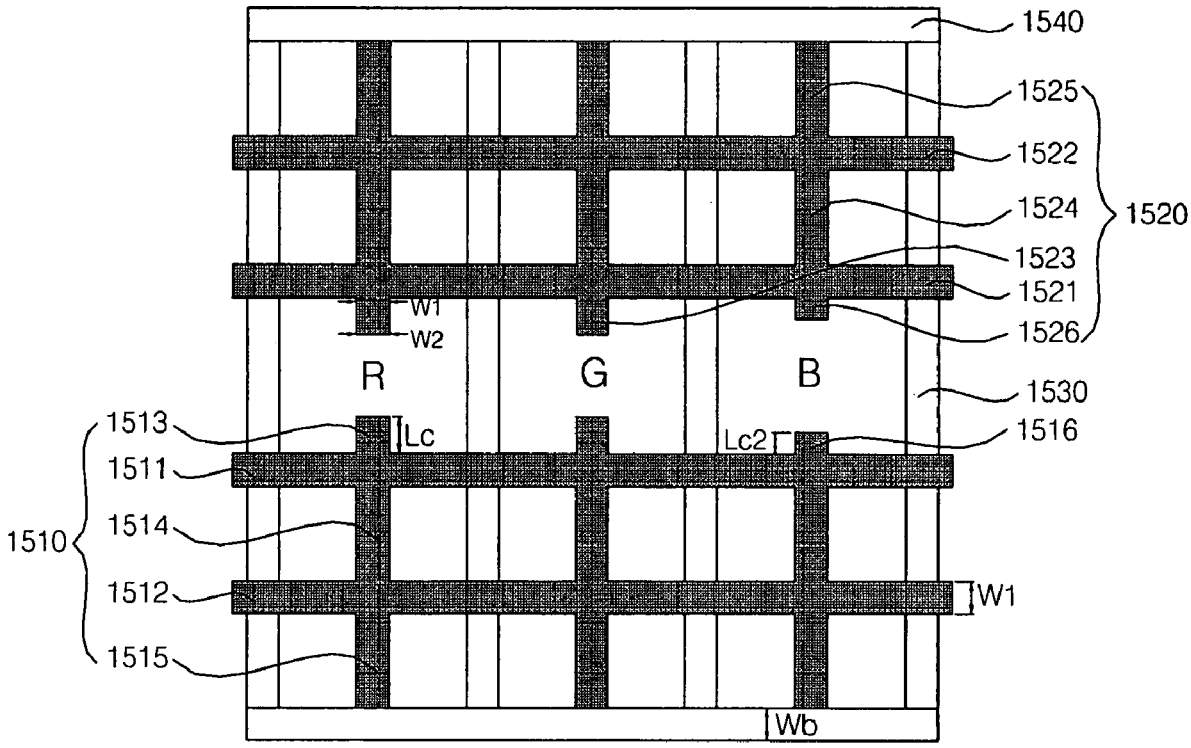
FIG. 16*a* to FIG. 16*b* are drawings showing a first embodiment of the electrode structure arranged in a plurality of discharge cells which are adjacent in a plasma display panel according to the present invention.
Figure 16B:
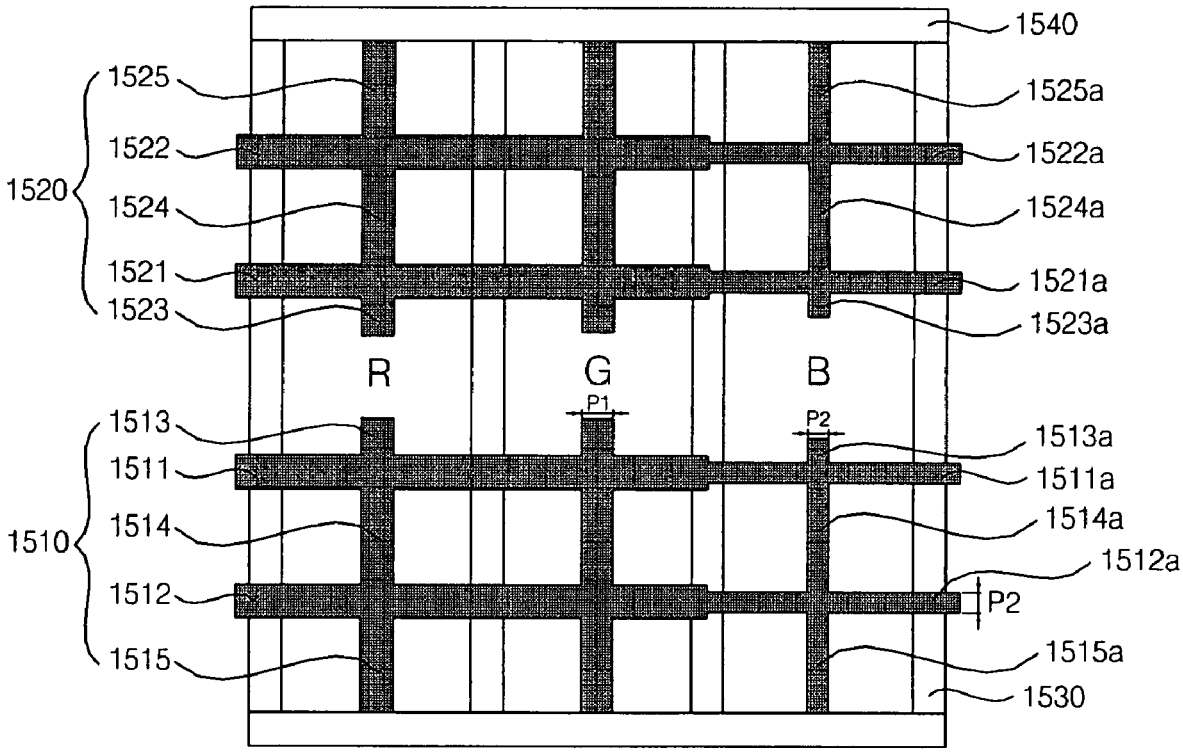

FIG. 16*a* to FIG. 16*b* are drawings showing a first embodiment of the electrode structure arranged in a plurality of discharge cells which are adjacent in a plasma display panel according to the present invention. The same description illustrate in FIG. 4 to FIG. 8 among the electrode structure shown in FIG. 16*a* to FIG. 16*b* will be omitted.

Referring to FIG. 16*a*, sustain electrodes are symmetrized based on the center of the electrode line to form a pair. Each sustain electrode comprises a line portion including at least two electrode lines 1511, 1512, 1521, 1522 crossing the discharge cell.

In addition, a protrusion includes a first projecting electrode 1513, 1523 and a second projecting electrode 1516, 1526 which are protruded to the center of the discharge cell in the discharge cell and connected to the electrode line 1511, 1521 which is the closest to the center of the discharge cell, and a third projecting electrode 1515, 1525 protruded in the opposite direction of the center of the discharge cell in the discharge cell and connected to the electrode line 1512, 1522 which is most far from the center of the discharge cell.

Further, each sustain electrode includes one bridge electrode 1514, 1524 connecting the two electrode lines.

The first projecting electrodes 1513, 1523 are connected to the electrode lines 1511, 1521 which are close to the center of discharge cell in R, G discharge cell among a plurality of discharge cells.

Further, in B discharge cell among a plurality of discharge cells, the second projecting electrodes 1516, 1526 are connected to the electrode lines 1511, 1521 which are close to the center of the discharge cell. It is preferable that the first projecting electrode 1513, 1523 and the second projecting electrodes 1516, 1526 are positioned in the center of the electrode line so as to correspondingly lower the firing voltage of PDP effectively in each discharge cell.

In addition, the length Lc2 of the second projecting electrode 1516, 1526 positioned in B discharge cell is formed with 0.70 times to 0.98 times of the length Lc2 of the first projecting electrode 1513, 1523 positioned in R discharge cell and G discharge cell. In that case, the luminance of the panel can be improved by increasing the color temperature of the blue B emitted from B discharge cell including the second projecting electrode.

As to such projecting electrodes 1513, 1523, 1516, 1526, since the size is very small, the width W1 of the portion connected with the electrode lines 1511, 1521 of the projecting electrodes 1513, 1523, 1516, 1526 can be substantially broader than the width W2 of the end portion of the projecting electrode due to the tolerance of the manufacturing process, while the width of the end portion of the projecting electrode can be broader.

The bridge electrodes 1514, 1524 connect each electrode lines respectively. The bridge electrode 1514, 1524 helps the discharge generated through the protruding electrode to be easily diffused to the electrode line 1512, 1522 which is far from the center of the discharge cell.

In FIG. 16*a*, bridge electrodes 1512, 1522 are positioned in the discharge cell, however, can be formed to be overlapped on the column barrier rib 1530 among barrier ribs partitioning off the discharge, if necessary.

The third projecting electrodes 1515, 1525 connected to the electrode lines 1512, 1522 which are far from the center of the discharge cell in one discharge cell, while protruding to the opposite direction of the center of the discharge cell. Accordingly, a discharge can be diffused to the space between the electrode lines 1512, 1522 and the barrier rib 1530, 1540. That is, the luminous efficiency of the plasma display panel can be improved by increasing the discharge diffusion efficiency.

Referring to FIG. 16*b*, the sustain electrodes comprise electrode lines 1511*a*, 1512*a*, 1521*a*, 1522*a* of B discharge cell connected to electrode lines 1511, 1512, 1521, 1522 which are positioned in R discharge cell or G discharge cell among a plurality of discharge cells In addition, the sustain electrodes includes one fourth projecting electrode 1513*a*, 1523*a* which is protruded to the center of the B discharge cell in the B discharge cell and connected to the electrode line 1511*a*, 1521*a* which is the closest to the center of the B discharge cell, and a fourth projecting electrode 1515*a*, 1525*a* protruded in the opposite direction of the center of the B discharge cell in the discharge cell and connected to the electrode line 1512*a*, 1522*a* which is most far from the center of the B discharge cell.

Further, the sustain electrode includes one bridge electrodes 1514*a*, 1524 connecting two electrode lines positioned in the B discharge cell among a plurality of discharge cells.

It is preferable that the width P2 of the sustain electrode positioned in the B discharge cell among a plurality of discharge cells ranges from 0.70 times to 0.98 times of the width P1 of the sustain electrodes 1510, 1520 positioned in the R discharge cell or the G discharge cell. In that case, the color temperature of the B discharge cell is improved and the luminance of the panel is improved.

In this way, the electrode structure according to the first embodiment of the present invention can improve the aperture ratio by suggesting the number of the electrode lines. Further, the firing voltage can be lowered by forming the projecting electrode, while the discharge diffusion efficiency can be increased due to the electrode line which is far from the center of the discharge cell and the bridge electrode. Moreover, by reducing the width of the electrode within the B discharge cell region or reducing the length of the projecting electrode, the color temperature and the luminance of the panel can be improved.

Figure 17A:
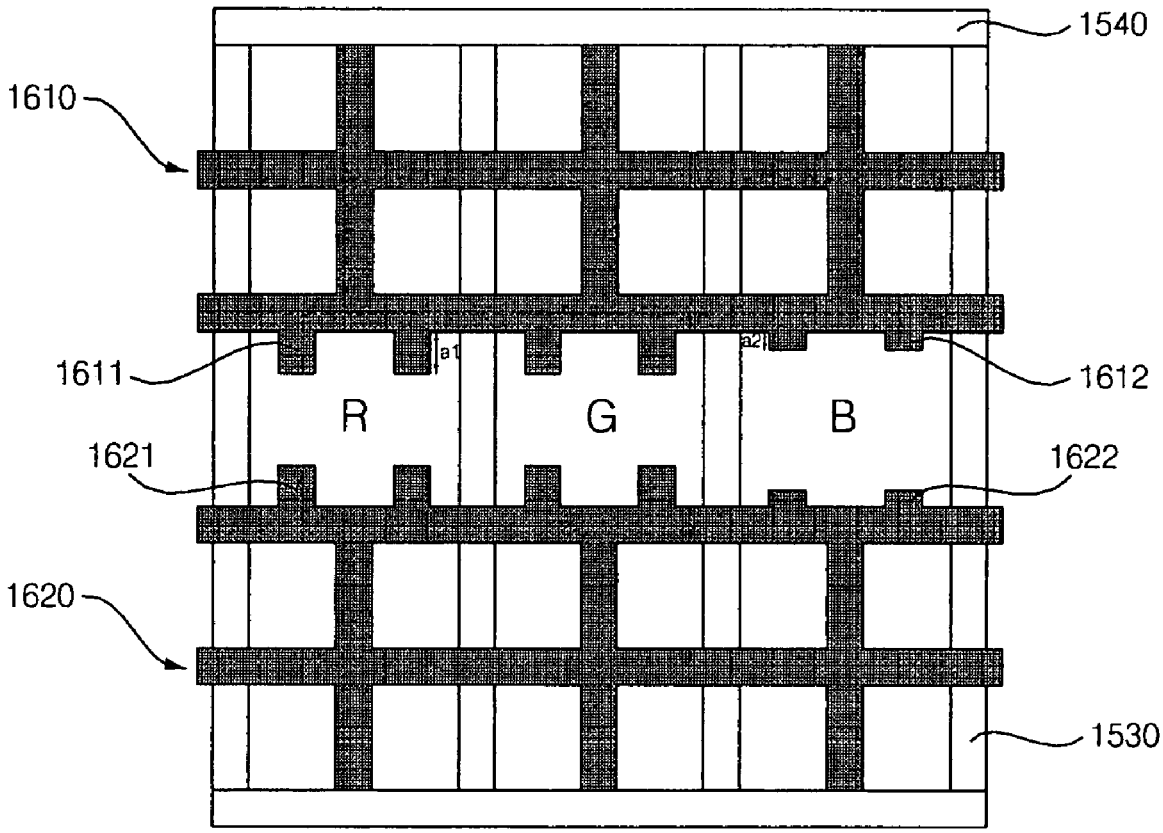
FIG. 17*a* to FIG. 17*b* are drawings showing a second embodiment of the electrode structure arranged in a plurality of discharge cells which are adjacent in a plasma display panel according to the present invention.
Figure 17B:
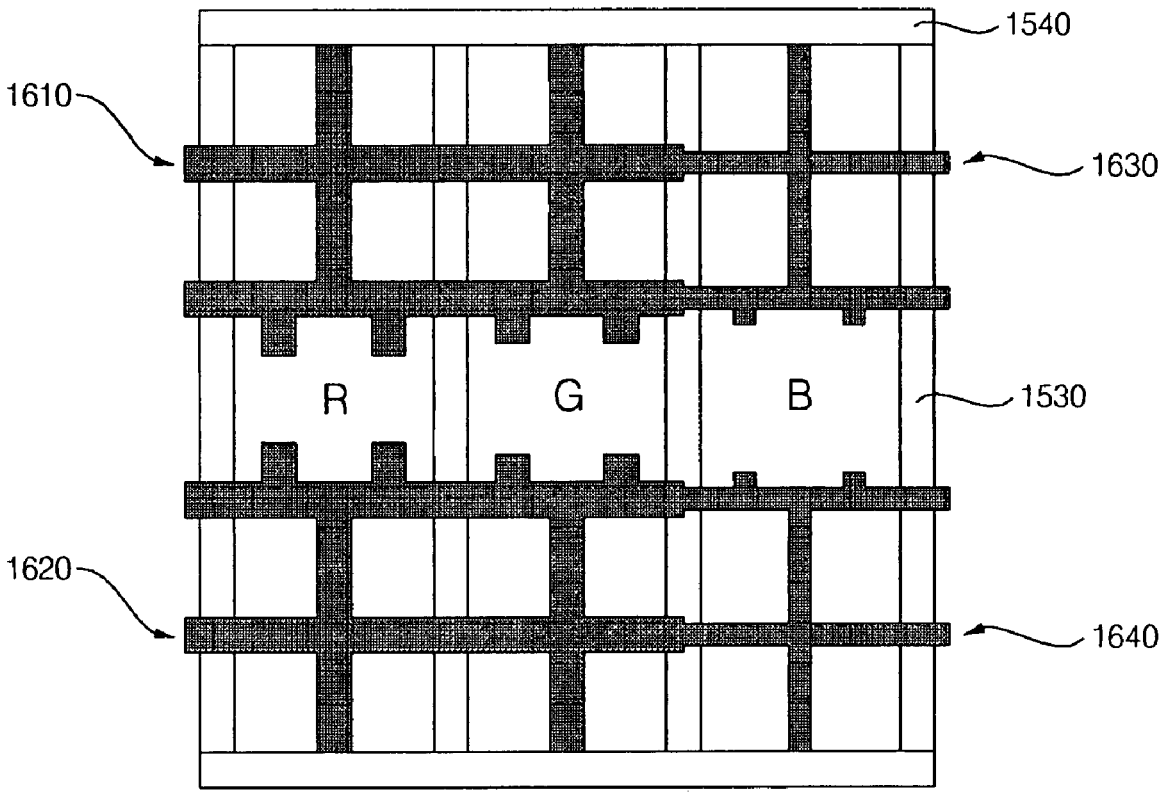

FIG. 17*a* to FIG. 17*b* are drawings showing a second embodiment of the electrode structure arranged in a plurality of discharge cells which are adjacent in a plasma display panel according to the present invention. The same description described in FIG. 4 to FIG. 8, and FIG. 16*a* to FIG. 16*b* among the electrode structure shown in FIG. 17*a* to FIG. 17*b* will be omitted.

Referring to FIG. 17*a* to FIG. 17*b*, sustain electrodes 1610, 1620 of the plasma display panel according to the present invention include two first projecting electrodes 1611, 1621 positioned in the R, G discharge cell among a plurality of discharge cells, and two second projecting electrodes 1612, 1622 positioned in the B discharge cell.

It is preferable that the length a2 of the second projecting electrodes 1612, 1622 ranges from 0.70 times to 0.98 times of the length a1 of the first projecting electrodes 1611, 1621. On the other hand, as shown in FIG. 17*b*, it is preferable that the width W2 of sustain electrodes 1630, 1640 which are positioned in the B discharge cell ranges from 0.70 times to 0.98 times of the width of sustain electrodes 1610, 1620 which are positioned in the R discharge cell and the G discharge cell. In that case, the color temperature of the B discharge cell is increased and the luminance of the panel can be improved.

Figure 18A:
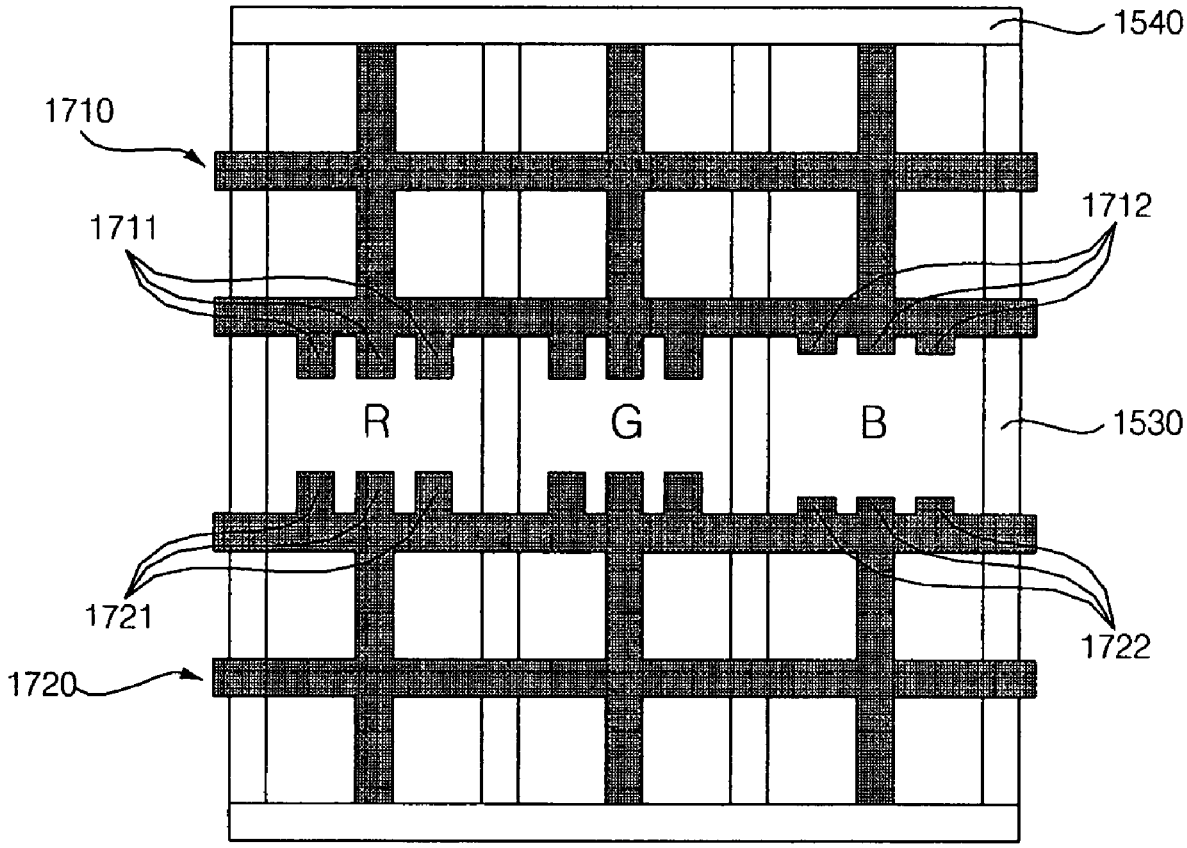
FIG. 18*a* to FIG. 18*b* are drawings showing a third embodiment of the electrode structure arranged in a plurality of discharge cells which are adjacent in a plasma display panel according to the present invention.
Figure 18B:
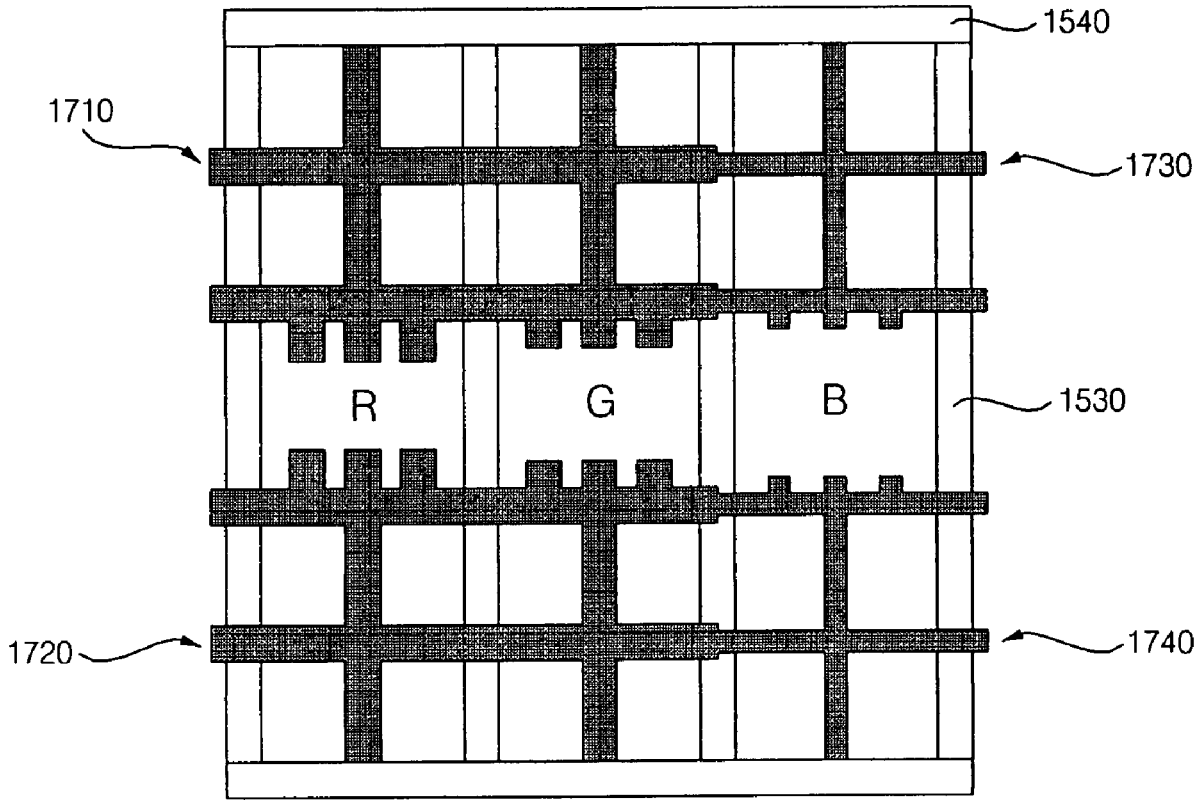

FIG. 18*a* to FIG. 18*b* are drawings showing a third embodiment of the electrode structure arranged in a plurality of discharge cells which are adjacent in a plasma display panel according to the present invention. The same description described in FIG. 4 to FIG. 8, and FIG. 16*a* to FIG. 17*b* among the electrode structure shown in FIG. 18*a* to FIG. 18*b* will be omitted.

As shown in FIG. 18*a* to FIG. 18*b*, as to the third embodiment of the electrode structure of the plasma display panel according to the present invention, the sustain electrodes 1710, 1720, 1730, 1740 include a first projecting electrode 1711, 1721 which is positioned in the R discharge cells and the G discharge cell among a plurality of discharge cells, and a second projecting electrode 1712, 1722 positioned in the B discharge cell.

The first projecting electrode 1711, 1721 and the second projecting electrode 1712, 1722 are connected to the electrode line which are close to the center of the discharge cell in each discharge cell, protruded to the center of the discharge cell. Preferably, in one discharge cell, one first projecting electrodes 1711, 1712 is formed in the center of the electrode line, while other two first projecting electrodes 1711, 1712 are formed to be symmetrical based on the center of the electrode line.

Further, it is preferable that the second projecting electrodes 1712, 1722 are formed to be substantially identical with the first projecting electrodes 1711, 1712, and the length of the second projecting electrodes 1712, 1722 ranges from 0.70 times to 0.98 times of the length of the first projecting electrodes 1711, 1712.

In that case, the aperture ratio of the B discharge cell can be broader, the color temperature of B discharge cell can be improved, and the luminance of the panel can be improved.

As shown in FIG. 18*b*, it is preferable that the width W2 of the sustain electrodes 1730, 1740 positioned in B discharge cell among a plurality of discharge cells ranges from 0.70 times to 0.98 times of the width of the sustain electrodes 1710, 1720 positioned in R discharge cell and G discharge cell. In that case, the aperture ratio of B discharge cell can be broader, the color temperature of B discharge cell can be improved, and the luminance of the panel can be improved.

Figure 19:
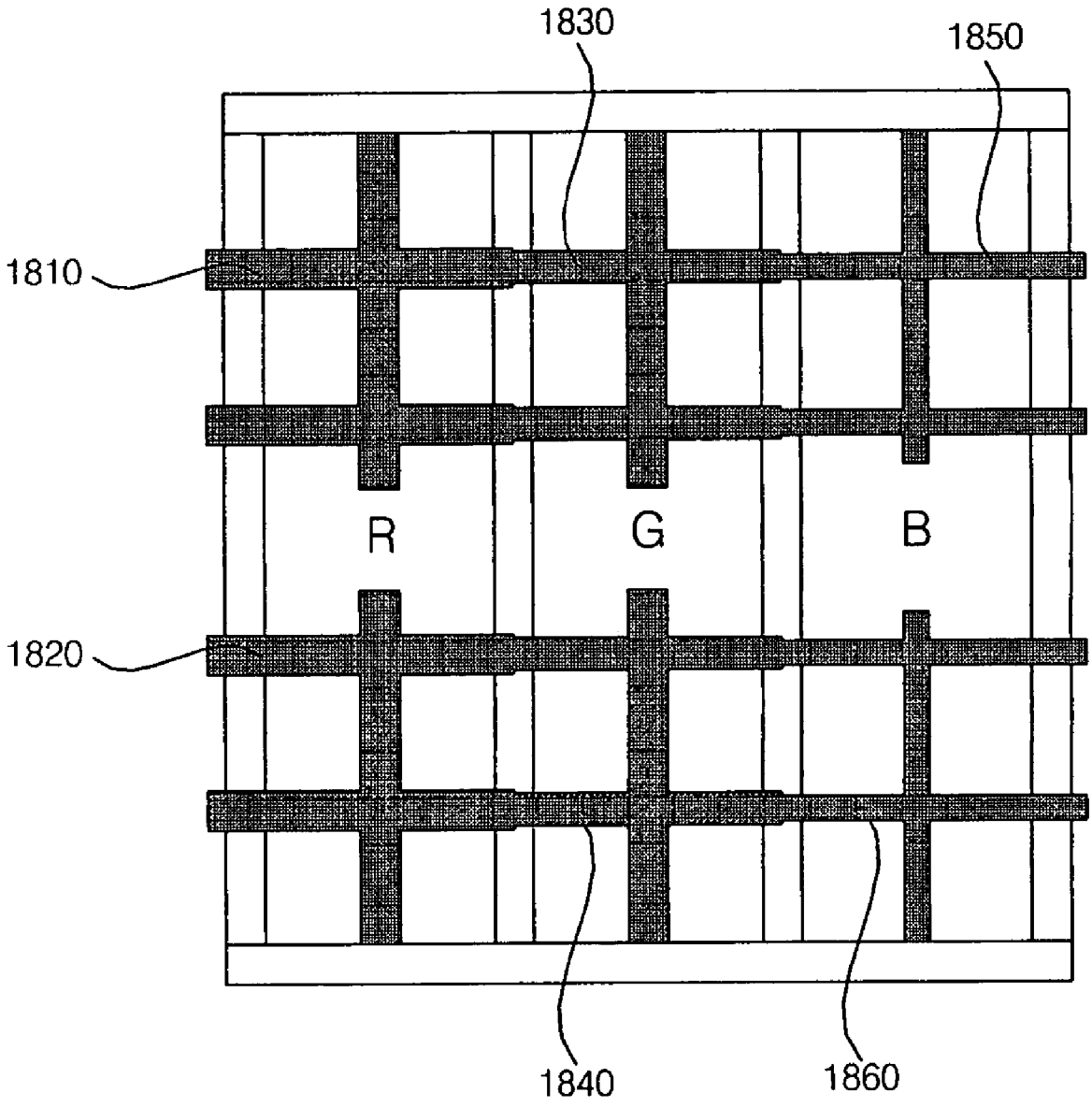
FIG. 19 is a drawing showing a fourth embodiment of the electrode structure arranged in a plurality of discharge cells which are adjacent in a plasma display panel according to the present invention.

FIG. 19 is a drawing showing a fourth embodiment of the electrode structure arranged in a plurality of discharge cells which are adjacent in a plasma display panel according to the present invention. The same description described in FIG. 4 to FIG. 8, and FIG. 16*a* to FIG. 16*b* among the electrode structure shown in FIG. 19 will be omitted.

Referring to FIG. 19, sustain electrodes of the plasma display panel according to the present invention include a first sustain electrode 1810, 1820 positioned in R discharge cell among a plurality of discharge cells, a second sustain electrode 1830, 1840 positioned in G discharge cell, and a third sustain electrode 1850, 1860 positioned in B discharge cell. At this time, it is preferable that the sustain electrodes positioned in R, G, and B discharge cell are connected each other.

Furthermore, by differently forming the width of each sustain electrode formed in a plurality of discharge cell, the color temperature of the panel can be improved and the luminance can be improved. At this time, it is preferable that the width of the first sustain electrode positioned in R discharge cell is formed to be most broad, while the width of the third sustain electrode positioned in B discharge cell is formed to most small in consideration of the color temperature of R, G, B and the luminous efficiency.

For example, it is preferable that the width of the second sustain electrodes 1830, 1840 positioned in G discharge cell among a plurality of discharge cells ranges from 0.80 times to 0.98 times of the width of the first sustain electrodes 1810, 1820 positioned in R discharge cell, while the width of the third sustain electrodes 1850, 1860 positioned in B discharge cell ranges from 0.80 times to 0.98 times of the width of the second sustain electrodes 1830, 1840 positioned in G discharge cell.

Table 1 shows the result of the color temperature of the panel and the luminance according to the width ratio of the sustain electrodes positioned in R, G, B discharge cell respectively.

TABLE 1

| width of a first sustain electrode:width of a second sustain electrode:width of a third sustain electrode | color temperature | luminance |
|---|---|---|
| 1.00:1.00:1.00 | 7113 | 161 |
| 1.03:1.00:0.97 | 7532 | 162 |
| 1.06:1.00:0.94 | 8251 | 163 |
| 1.09:1.00:0.91 | 8880 | 164 |

Referring to table 1, the width of the second sustain electrodes positioned in G discharge cell among a plurality of discharge cells ranges from 0.91 times to 0.97 times of the width of the first sustain electrodes positioned in R discharge cell, at the same time, the width of the third sustain electrodes positioned in B discharge cell ranges from 0.91 times to 0.97 times of the width of the second sustain electrodes positioned in G discharge cell. Further, the color temperature of the panel and the luminance increases as the width of the first, the third sustain electrode is enlarged or becomes smaller by contrast with the width of the second sustain electrode.

Figure 20:
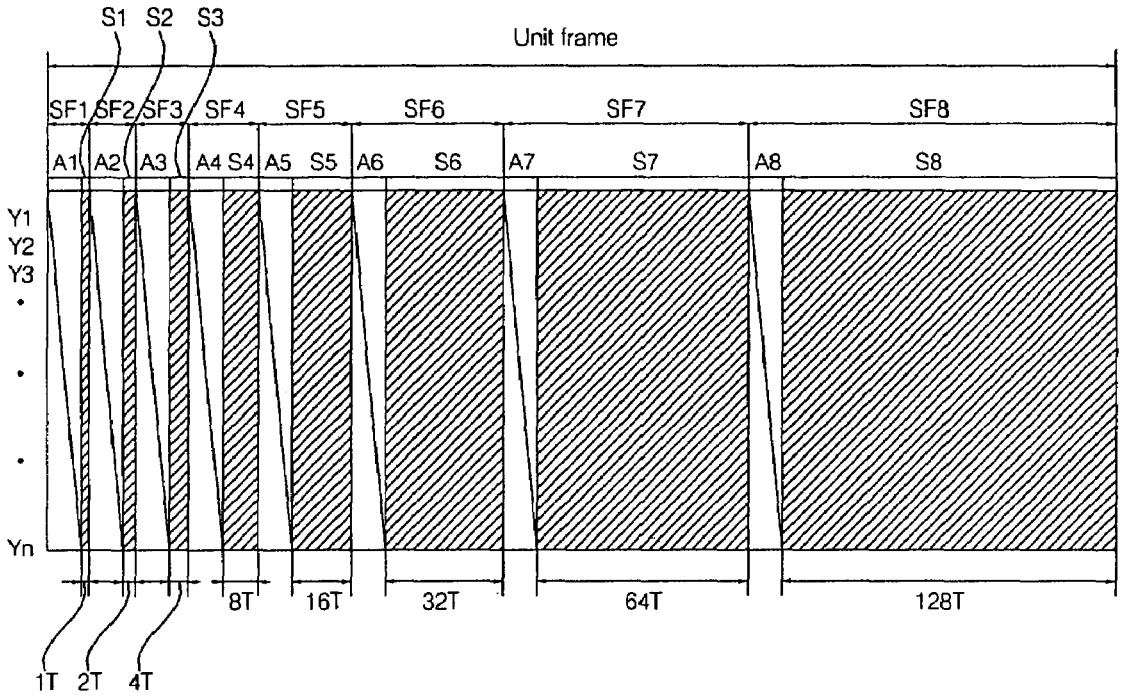
FIG. 20 is a drawing showing an embodiment of the method in which a frame of an image of a plasma display panel is time-divided into a plurality of subfields for driving.

FIG. 20 is a drawing showing an embodiment of the method in which a frame of an image of a plasma display panel is time-divided into a plurality of subfields for driving.

Referring to FIG. 20, the unit frame can be time-divided driven with a predetermined number, for example, eight subfields SF1, . . . , SF8 so as to express the gray level of an image. Further, each subfield SF1, . . . , SF8 is divided into a reset period (not shown), an address period A1, . . . , A8, and a sustain period S1, . . . , S8.

In each address period A1, . . . , A8, a data signal is applied to the address electrode X, while a scan pulse corresponding to it is sequentially applied to each scan electrode Y. In each sustain period S1, . . . , S8, the sustain pulse is alternately applied to the scan electrode Y and the sustain electrode Z such that the sustain discharge is generated in discharge cells selected in the address period A1, . . . , A8.

The luminance of the plasma display panel is in proportion to the number of sustain discharge of the sustain period S1, . . . , S8 in the unit frame. In case one frame forming one image is expressed with 8 subfields and 256 gray level, the sustain pulse having a different number can be allocated to each subfield with the rate of 1, 2, 4, 8, 16, 32, 64, 128. To obtain the luminance of 133 gray level, cells are addressed to generate a sustain discharge during the subfield 1 period, the subfield 3 period, and the subfield 8 period.

In the meantime, according to the weighted value of the subfields by Automatic Power Control APC step, the number of sustain discharge allocated to each subfield can be variably determined. That is, in FIG. 20, it was exemplified that a frame is divided into 8 subfields. However, the invention is not restricted to that. Hence, the number of the subfield forming a frame can be variously changed according to the design type. For example, it can be divided into below or over 8 subfields such as 12 subfields or 16 subfields to drive the plasma display panel.

In addition, the number of sustain discharge allocated to each subfield can be variously changed in consideration of the gamma characteristics or the panel characteristics. For example, the gray level allocated to the subfield 4 can be lowered from 8 to 6, while the gray level allocated to the subfield 6 can be enhanced from 32 to 34.

Figure 21:
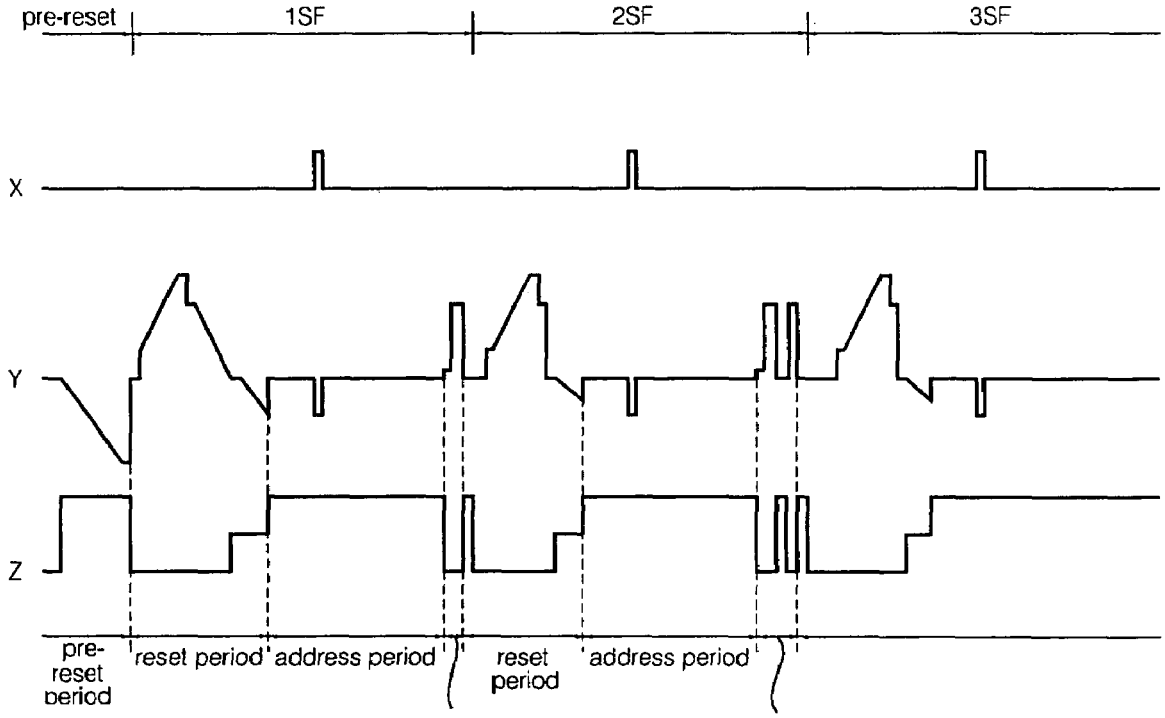
FIG. 21 is a waveform diagram showing an embodiment of driving signals for driving a plasma display panel in the divided subfield.

FIG. 21 is a waveform diagram showing an embodiment of driving signals for driving a plasma display panel in the divided subfield.

Referring to FIG. 21, the subfield SF can be divided into a reset period, an address period, and a sustain period, while the reset period can be divided again into a set up period and a set down period. In the reset period, the electric charge inside of the discharge cell is initialized. In the address period, the discharge cell in which an image is displayed or not displayed is selected. In the sustain period, the image is displayed by generating a sustain discharge in the discharge cell in which the image selected in the address period is displayed.

In the set up period, the set up signal which gradually rises is applied to the scan electrode Y such that the set up discharge is generated in all discharge cells to accumulate wall charges. In the set down period, the set down signal which gradually falls is applied to generate a weak discharge, thereby, the wall charges are uniformly remained in the discharge cell to the extent that the address discharge can be stably generated.

Further, a pre reset period exists prior to the reset period to support the sufficient forming of the wall charges. When the waveform in which the scan electrode Y voltage gradually decreases is applied prior to the reset period, the voltage of the positive polarity is applied to the sustain electrode Z to generate the pre reset discharge. It is preferable that the pre reset period exists only in the first subfield SF1 in consideration of the drive margin.

In the address period, the scan signal is sequentially applied to each scan electrode Y. Simultaneously, data signal of the positive polarity synchronized with the scan signal applied to the scan electrode Y is applied to the address electrode X. The address discharge is generated in the discharge cell by adding the difference between the voltage of the scan signal and the data signal to the wall voltage generated in the reset period such that wall charges for the sustain discharge are formed.

In the sustain period, the sustain signal is alternately applied to the scan electrode Y and the sustain electrode Z. As to the discharge cell selected by the address discharge, whenever each sustain signal is applied, the sustain discharge, that is, the display discharge occurs.

In the meantime, the waveforms shown in FIG. 21 are an embodiment of the signals for driving the plasma display panel according to the present invention. The invention is not restricted by waveforms shown in FIG. 21. For example, the reset period can be omitted in at least one subfield among a plurality of subfields forming one frame, the reset period can exist in the first subfield and the pre reset period can be omitted.

The polarity and voltage level of the driving signal shown in FIG. 21 can be changed, if necessary. The erase signal for the wall charge erase can be applied to the sustain electrode Z after the sustain discharge is completed. The single sustain drive in which the sustain signal is applied to one of the scan electrode Y and the sustain electrode Z to generate the sustain discharge can be used.

It will be apparent to those skilled in the art that various modifications and variation can be made in the present invention without departing from the spirit or scope of the present invention. Thus, it is intended that the present invention cover the modifications and variations of this invention provided they come within the scope of the appended claims and their equivalents.

What is claimed is:

1. A plasma display apparatus, comprising:

a front substrate;

a plurality of first and second electrodes formed on the front substrate;

a front dielectric layer covering the first and second electrodes;

a rear substrate that is faced with the front substrate;

a plurality of third electrodes formed on the rear substrate; and a plurality of discharge cells, each disposed in a place where respective ones of the first and second electrodes intersect with corresponding ones of the third electrodes, wherein at least one of the first or the second electrode is formed with one layer, wherein at least one of the plurality of first or second electrodes comprises:

a line portion including at least two electrode lines formed in a direction that intersects a corresponding one of the third electrodes, and a protrusion that protrudes from the line portion, wherein a width of the line portion arranged in a first discharge cell is different from a width of the line portion arranged in a second discharge cell, that is arranged to radiate a color different from a color of the first discharge cell, wherein a length of the protrusion arranged in the first discharge cell is different from a length of the protrusion arranged in the second discharge cell, and wherein at least one of the first or second electrodes is darker than the front dielectric layer.

2. The plasma display apparatus of claim 1, wherein the protrusion includes a curved portion having a predetermined curvature.

3. The plasma display apparatus of claim 2, wherein the line portion arranged in at least one of the first or second discharge cells includes two or more protrusions.

4. The plasma display apparatus of claim 1, wherein a width of the line portion arranged in the first discharge cell is larger than a width of the line portion arranged in the second discharge cell.

5. The plasma display apparatus of claim 1, wherein a width of the line portion arranged in the second discharge cell ranges from 0.70 times to 0.98 times a width of the line portion arranged in the first discharge cell.

6. The plasma display apparatus of claim 1, wherein the first discharge cell is a cell radiating a red light or a green light; and the second discharge cell is a cell radiating a blue light.

7. The plasma display apparatus of claim 1, wherein a width of the protrusion arranged in the second discharge cell ranges from 0.70 times to 0.98 times a width of the protrusion arranged in the first discharge cell.

8. The plasma display apparatus of claim 1, wherein the protrusion forms at least one closed loop.

9. The plasma display apparatus of claim 1, wherein, on the rear substrate, a dielectric layer; a barrier rib comprising a column barrier rib and a row barrier rib and partitioning off the discharge cell; and a phosphor layer are formed.

10. The plasma display apparatus of claim 9, wherein the first and the second electrodes further comprise a bridge electrode connecting the at least two electrode lines.

11. The plasma display apparatus of claim 10, wherein the bridge electrode overlaps the column barrier rib.

12. The plasma display apparatus of claim 1, wherein the length of the protrusion arranged in the first discharge cell is longer than the length of the protrusion arranged in the second discharge cell.

13. The plasma display apparatus of claim 1, wherein the length of the protrusion arranged in the second discharge cell ranges from 0.70 times to 0.98 times the length of the protrusion arranged in the first discharge cell.

14. A plasma display apparatus, comprising:

a front substrate;

a plurality of first and second electrodes formed on the front substrate;

a front dielectric layer covering the plurality of first and second electrodes;

a rear substrate that is faced with the front substrate;

a plurality of third electrodes formed on the rear substrate;

a plurality of discharge cells, each disposed in a place where respective ones of the first and second electrodes intersect with corresponding ones of the third electrodes, a line portion formed in a direction intersecting the third electrode; and a protrusion protruded from the line portion, wherein at least one of the plurality of the first or the second electrodes is formed with one layer, wherein widths of the line portions arranged respectively in a first discharge cell, a second discharge cell, and a third discharge cell, that radiate different light, are different from each other, wherein the first discharge cell radiates green light, the second discharge cell radiates red light, and the third discharge cell radiates blue light, wherein the protrusion includes a curved portion having a predetermined curvature, and wherein at least one of the first or second electrodes is darker than the front dielectric layer.

15. The plasma display apparatus of claim 14, wherein the width of the line portion arranged in the first discharge cell ranges from 0.80 times to 0.98 times the width of the line portion in the second discharge cell.

16. The plasma display apparatus of claim 14, wherein the width of the line portion arranged in the third discharge cell ranges from 0.80 times to 0.98 times the width of the line portion arranged in the first discharge cell.

* * * * *